US007062992B2

(12) United States Patent
Spirer

(10) Patent No.: US 7,062,992 B2
(45) Date of Patent: Jun. 20, 2006

(54) CONSTANT ROTATION ROTARY TORQUE MULTIPLIER

(75) Inventor: Steven E. Spirer, Washington Township, NJ (US)

(73) Assignee: Norwolf Tool Works, Westwood, NJ (US)

( * ) Notice: Subject to any disclaimer, the term of this patent is extended or adjusted under 35 U.S.C. 154(b) by 0 days.

(21) Appl. No.: 11/263,527

(22) Filed: Oct. 31, 2005

(65) Prior Publication Data

US 2006/0090606 A1 May 4, 2006

Related U.S. Application Data

(60) Provisional application No. 60/623,643, filed on Oct. 29, 2004.

(51) Int. Cl.
*B25B 13/46* (2006.01)

(52) U.S. Cl. ..... 81/57.3; 81/57.39; 81/60

(58) Field of Classification Search ..... 81/57, 81/57.3, 57.39, 58, 60, 61, 62, 63.1, 63.2, 81/57.38

See application file for complete search history.

(56) References Cited

U.S. PATENT DOCUMENTS 6,260,443 B1 * 7/2001 Spirer ..... 81/57.39
6,370,987 B1 * 4/2002 Wilson et al. ..... 81/58.2
6,427,559 B1 * 8/2002 Junkers ..... 81/57.39

* cited by examiner

*Primary Examiner*—Jacob K. Ackun, Jr.
(74) *Attorney, Agent, or Firm*—Weingram & Associates, P.C.

(57) ABSTRACT

A wrench with torque augmenting means consisting of an output socket wrench which utilizes a ratchet arrangement and which includes an input cog that is adapted to receive an external drive tool. The input cog constantly rotates under the influence of the external drive tool and a camming surface formed on the arm of the input cog coacts with a cam follower surface on the drive plate of the output to move the drive plate. A spring within the housing of the apparatus connected to the drive plate will cause the drive plate to return to its initial position where the action of the camming surface of the rotating cog arm from the input cog can then repeat its function. Rotary movement of the output in one direction is accomplished during the oscillation of the drive plate by means of the ratchet positioned within the drive plate.

10 Claims, 20 Drawing Sheets

CONSTANT ROTATION ROTARY TORQUE MULTIPLIER

This appln. claims the benefit of provisional appln. 60/623,643 filed on Oct. 29, 2004.

FIELD OF THE INVENTION

The present invention relates to torquing apparatus and in particular, to hand operated apparatus adapted to transmit and/or augment torque from an input to an output of the apparatus. Additionally, the invention relates to a device which is especially adaptable for use with external torque providing apparatus such as rotary air wrenches.

BACKGROUND OF THE INVENTION

This invention relates to the inventions set forth in the inventor's previous U.S. Pat. Nos. 5,953,966, 6,148,694, and 6,260,443, which are incorporated in this disclosure and are included herewith. These patents show a hand wrench with torque augmenting means in which an input drive is connected to an output drive by means of a link. The input drive oscillates in a given path of travel to allow for movement of the output from the device. However, these devices require that the input device be reversed back to an initial position at the end of the input stroke therefore discontinuing the action of the apparatus during the reversal of the input to its initial starting position.

The present invention provides an apparatus which allows the input to the device to constantly rotate without having to be reversed back to an initial position. This enables the use of tools with long or continuous strokes and greatly enhances the usefulness of the tool. For example, it is now possible to use air wrenches, which continuously rotate, attached to the input of torque multiplying device.

SUMMARY OF THE INVENTION

The present invention provides a simple, efficient and lightweight wrench with torque augmenting means consisting of an output socket wrench which utilizes a ratchet arrangement and which includes an input cog that is adapted to receive an external drive tool. The input cog constantly rotates under the influence of the external drive tool and a camming surface formed on the arm of the input cog coacts with a cam follower surface on the drive plate of the output to move the drive plate. A spring within the housing of the apparatus connected to the drive plate will cause the drive plate to return to its initial position where the action of the camming surface of the rotating cog arm from the input cog can then repeat its function. Rotary movement of the output in one direction is accomplished during the oscillation of the drive plate by means of the ratchet positioned within the drive plate.

OBJECTS OF THE INVENTION

Accordingly, it is an object of the present invention to provide a torque augmenting tool which allows for an external drive tool to be engaged with a rotatable or revolving input.

It is another object of the present invention to provide a torque augmenting tool which allows for an external drive tool to be engaged with the rotatable input and to rotate continuously to produce an augmented torque at the output of the torque augmenting tool.

Another object of the present invention is to provide a torque augmenting tool which can operate continuously without having to reposition the input portion of the tool.

Another object of the present invention is to provide a torque augmenting tool which does not have to stop or reverse the input portion of the tool.

Another object of the present invention is to provide a torque augmenting tool which allows for continuous operation and rotation of the input portion of the tool.

Another object of the present invention is to provide a torque augmenting tool which is adaptable for use with continuously operating rotary torque tools such as air wrenches, etc.

Another object of the present invention is to provide a torque augmenting tool which is durable.

Another object of the present invention is to provide a torque augmenting tool which is relatively inexpensive to fabricate.

Another object of the present invention is to provide a torque augmenting tool which is relatively simple.

Another object of the present invention is to provide a torque augmenting tool which is reliable in operation.

BRIEF DESCRIPTION OF THE DRAWINGS

For a more complete understanding of the present invention, reference may be had to the following description of the preferred embodiments taken in connection with the following drawing, of which.

DETAILED DESCRIPTION OF THE PREFERRED EMBODIMENTS

Figure 1:
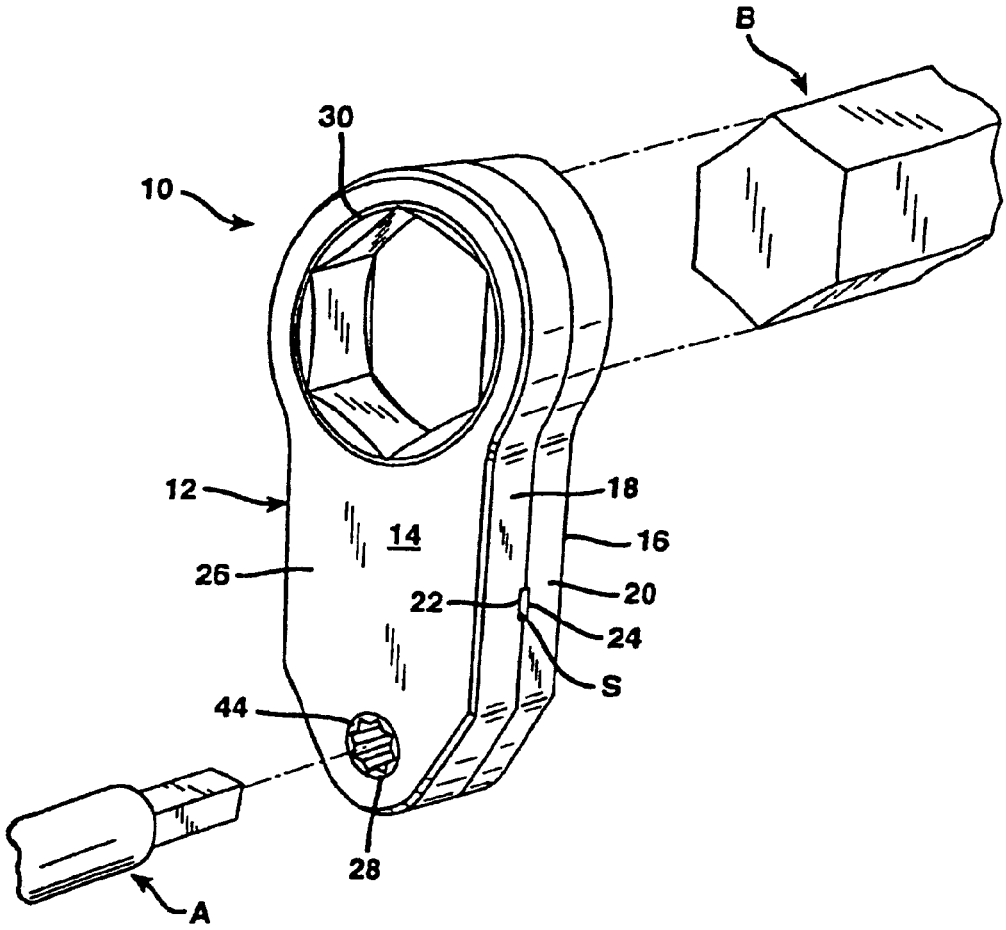
FIG. 1 is a perspective view showing a hand wrench with torque augmenting means known in the art.
Figure 2:
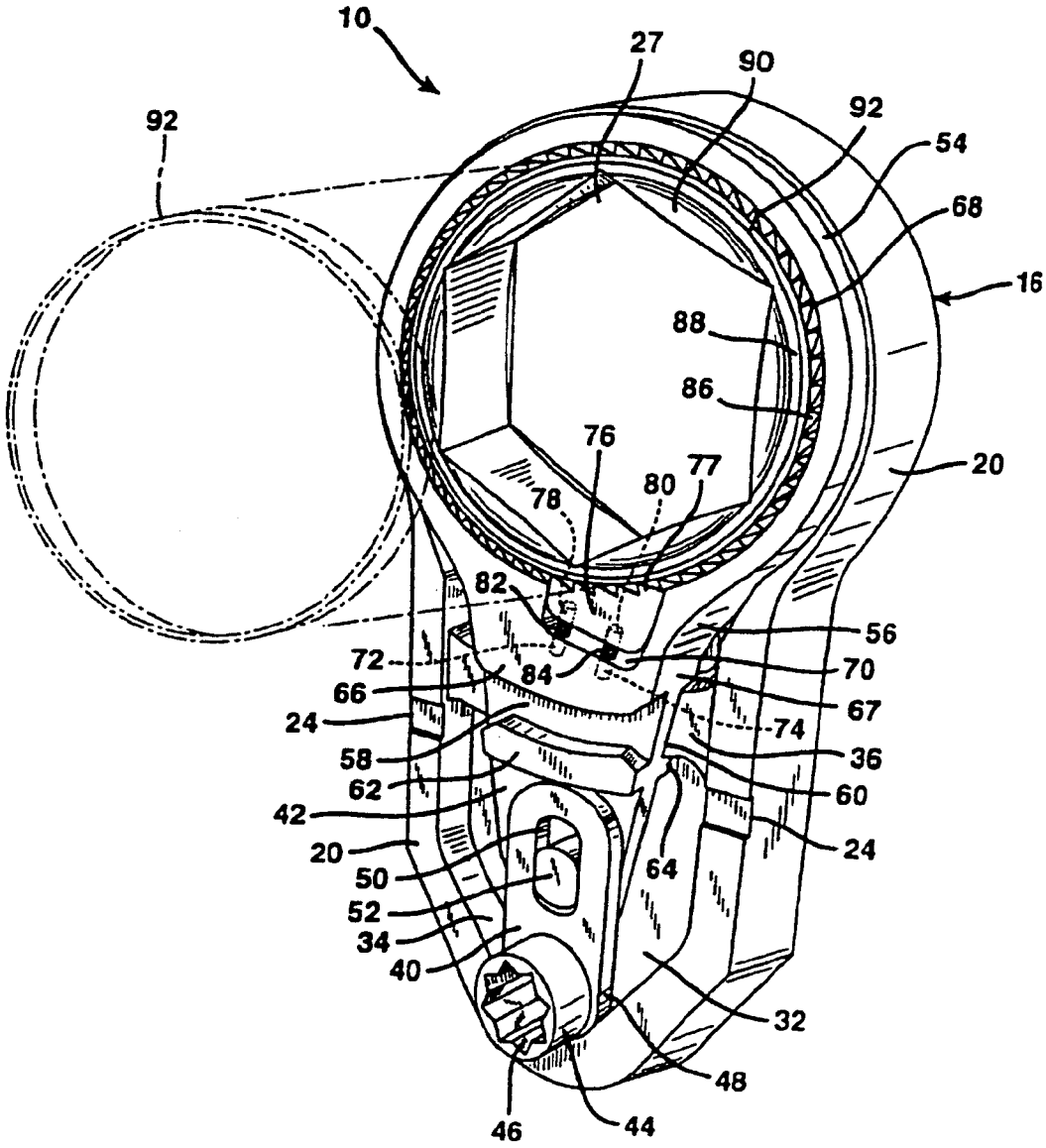
FIG. 2 is a top perspective view showing internal elements of the hand wrench.

Referring to FIGS. 1 and 2, a hand wrench having torque augmenting means of the present invention is shown generally at 10. The augmenter 10 is constructed to receive an external drive input A and transmit or augment the torque from the input A to an output B, such as a hex-sided stud or bolt.

The augmenter 10 consists of a housing 12 which is constructed from a pair of halves 14,16. The halves 14,16 can be held together by conventional mechanical fasteners such as screws, or with a friction fit. Each one of the halves 14,16 is provided with a continuous side wall 18,20 in which a corresponding detent or cutout 22,24 is formed. When the halves 14,16 are brought together to form the housing 12, the cutouts 22,24 formed in the respective side walls 18,20 are aligned in registration with each other to provide a space S at which force can be exerted to part the halves 14,16.

The half 14 has an exterior surface 26 upon which printed indicia can be displayed. The indicia can be instructions for operating the tool, logos, safety notices, etc. The half 16 has an exterior surface also for printed indicia which is not shown due to the perspective of the drawing Figures.

The half 14 is constructed with a small aperture 28 at one end thereof, the aperture 28 extending from the surface 26 completely through the half 14. An opposite end of the half 14 is formed with a larger aperture 30 which similarly extends from the surface 26 completely through the half 14.

Figure 3:
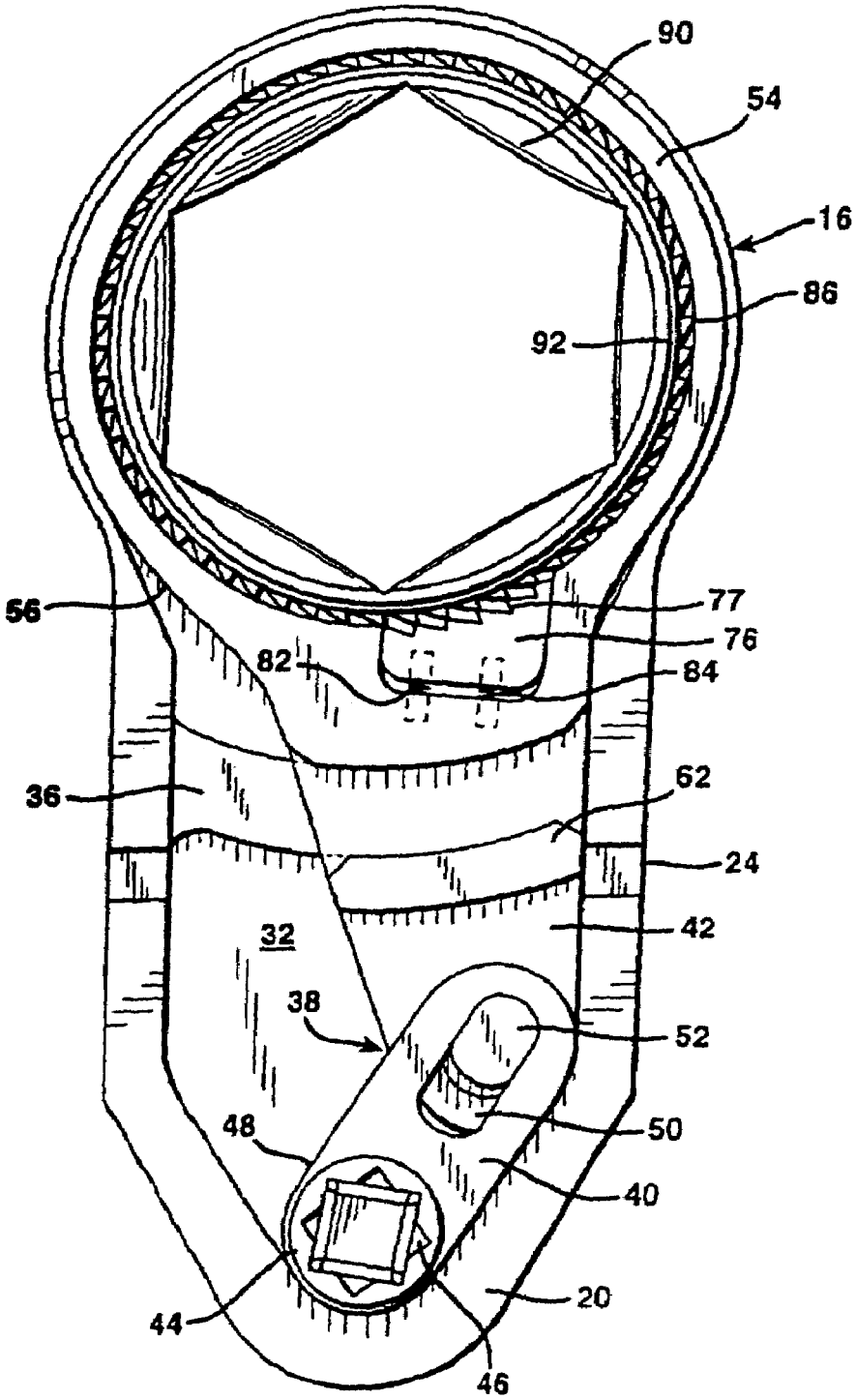
FIG. 3 is a top plan view showing the hand wrench at rest for a torque operation.

Referring also to FIGS. 2 and 3, additional elements of the augmenter 10 are also disclosed.

The half 16 includes an interior floor 32 from which the continuous side wall 20 extends upward therefrom. The side wall 20 is provided with an inner surface 34. An arcuate guide bar 36 extends upward from the floor 32. The guide bar 36 extends across the floor 32 such that each one of the opposed ends of the guide bar 36 is connected to a corresponding portion of the inner surface 34 of the continuous side wall 20 at opposite sides of the floor 32.

In FIG. 3, the augmenter 10 of the present invention is shown at rest ready to commence a torque operation. The elements of the augmenter 10 which enable the transmission and augmenting of torque are as follows.

A linkage assembly shown generally at 38 is constructed and arranged for operation when the halves 14,16 are joined together. The linkage assembly 38 includes a drive finger 40 and a driven arm 42.

The drive finger 40 has a first end from which an upstanding cylindrical portion 44 extends. The cylindrical portion 44 extends through both halves 14,16 when joined together. The drive finger 40 rotates about the cylindrical portion 44. The cylindrical portion 44 is provided with a hex or other multi-sided aperture 46 (FIG. 2) extending completely therethrough. The aperture 46 is adapted to act as an engaging receptacle for a multi-sided male drive member A. The aperture 46 is constructed and arranged in the drive finger 40 to be in registration with the aperture 28 of the half 14. The half 16 is similarly provided with an aperture which is in registration with the aperture 28 of the half 14, such that when the halves 14,16 are joined to each other with the linkage assembly 38 disposed therebetween, the multi-sided aperture 46 of the drive plate 40 is accessible at the smaller aperture 28 of the half 14 or at the corresponding aperture (not shown) in the other half 16. This permits the user to extend the drive input A completely through the housing 12, or to enable access to the engaging receptacle from either side of the housing. Therefore, the receptacle will always be accessible even if necessary to turn the augmenter 10 over for an operation.

The drive finger 40 is constructed with a side wall generally shown at 48 which substantially conforms to the tapered shape of the inner surface 34 of the side wall 20 of the half 16. As shown in FIG. 3, an arcuate portion of the side wall 48 is constructed to rest against and be received by the complimentary tapered inner surface 34. This permits the drive finger 40 to pivot in position and rest against the side wall 20. However, as will be discussed hereinafter, the drive finger 40 does not exert a pressure load against the side wall 20 which would be sufficient to weaken the side wall 20.

The opposite, free end of the drive finger 40 is formed with an oblong-shaped aperture 50 extending completely therethrough. A longitudinal axis of the oblong-shaped aperture 50 bisects a central axis of the multi-sided aperture 46.

The driven arm 42 includes at one end a pin 52 extending therefrom. The pin 52 is constructed and arranged to be in registration with and received by the oblong-shaped aperture 50 of the drive finger 40. The pin 52 is similarly oblong-shaped and is of a height that preferably is at least equal to the depth of the oblong-shaped aperture 50, and does not exceed the greatest height of the driven arm 42. The pin 52 is rotatably mounted to the driven arm 42. Alternatively, the pin 52 may be circularly shaped and fixed to the driven 42.

The driven arm 42 widens as it extends to assume a circular shape. As also shown in the perspective view of FIG. 2, a larger, circular shaped portion of the driven arm 42 is shown generally at 54.

The driven arm 42 is provided with side walls 56 and 57 which are shaped to engage along their entire length or to engage substantially along their entire length the inner surface of the continuous wall 20 of the housing when the driven arm is at the end of its travel. This tends to distribute the forces produced by the side wall of the driven arm 42 along the entire housing, minimizing the stress at any one point.

The shape of the side wall 56 permits the driven arm 42 to pivot freely within the half 16 when the driven arm 42 coacts with the drive finger 40.

An arcuate boss 62 or ridge extends upward from the driven arm 42 to coact with the drive finger 40. The height of the boss 62 substantially corresponds to the thickness of the drive finger 40 for a purpose to be described with reference to FIGS. 4 and 5.

Grooves 58 and 60 respectively are machined in the driven arm leaving ridges 62 and 66 and 64 and 67 respectively. The grooves 58 and 60 are adapted to mate with a pair of arcuate ridges. The arcuate ridge on the floor of the top plate is not shown. The arcuate ridge on the bottom half being designated as . . . 36. The coaction of the grooves 60 on the driven arm with the arcuate ridge 36 on the back half of the housing provides a guide for movement of the driven arm and also provides for structural support of the driven arm as it is moved by the drive finger. The top of the side walls 62 and 66 and the front side and 64 and 67 on the rear extend to the inner surface of the housing when the housings are assembled.

As shown more particularly in FIG. 2, the arcuate guide bar 36 is sized and shaped to be received in the groove 60, while another arcuate guide bar (not shown due to the perspective view of the Figures) of half 14 is received in the groove 58. This construction permits the driven arm 42 to ride along the arcuate guide bar 36 and the prescribed angle of arc of the guide bar 36. The driven arm 42 widens generally at 66 into a circular portion having an aperture 68 extending completely therethrough and in registration with the large aperture 30 of the plate 14 and the aperture 27 of the plate 16. The circular portion 66 of the driven arm 42 is formed with a recess 70 in communication with the aperture 68. A pair of bores 72,74 are formed in the circular portion 66 of the driven arm 42 and open into the recess 70.

A pawl 76 is disposed in the recess 70. The pawl 76 is formed with a pair of bores 78,80, each of which is in registration with a corresponding one of the bores 72,74 of the driven arm 42. Springs 82,84 are disposed in the recess 70, each one having its opposed ends terminating in a corresponding one of the bores 72,78 and 74,80, respectively. The springs 82,84 resiliently bias the pawl 76 to float in the recess 70 so that inclined teeth 77 of the pawl 76 are urged to engage corresponding inclined teeth 86 of a ratchet 88 disposed in the large aperture 30.

The ratchet 88 fits in a stepped portion of the aperture 68. The aperture 68 has a larger diameter and a smaller diameter. The larger diameter will accommodate the teeth of the rachet and the small diameter will support the teeth and enclose the entire ratchet mechanism.

The ratchet 88 is circular in shape and is received in the large circular end 54 of the driven plate 42 to surround a hex socket 88. The ratchet 88 is connected to and preferably an integral part of the hex socket 90.

A circular shaped wear collar 92 is constructed and arranged to extend around the hex socket 90 above the ratchet teeth 86. The wear collar 92 is made from bronze or other soft alloy to reduce friction during a torque operation when the halves 14,16 are joined to form the housing 12.

The starting position of the torquing operation is shown for example in FIGS. 1 and 3. First, the housing 12 of the augmenter 10 is grasped and the large hex will be engaged with the item to be tightened such as the output shaft B. The handle of the wrench 12 is then manually turned much as a standard socket head wrench until the output shaft is tight and further movement of the handle manually is no longer possible. If augmented torque is required, then an augmenting drive shaft A is entered into the augmenting receptacle aperture 46. The input shaft A can then be rotated. This can either be a long lever, or it can be a power type of unit. However, even a twelve inch (12") additional lever rotating the augmenting receptacle will be sufficient to produce substantial augmenting torque, since the lever can be substantially longer than the length of the handle. Additionally, since the handle must be located in a fixed position in a specific location with respect to the output shaft to be tightened, there may not be sufficient room to obtain proper purchase for rotating the handle of the augmenter, whereas an auxiliary lever or rotating bar can extend to an area of greater freedom when using the augmenting feature.

Figure 4:
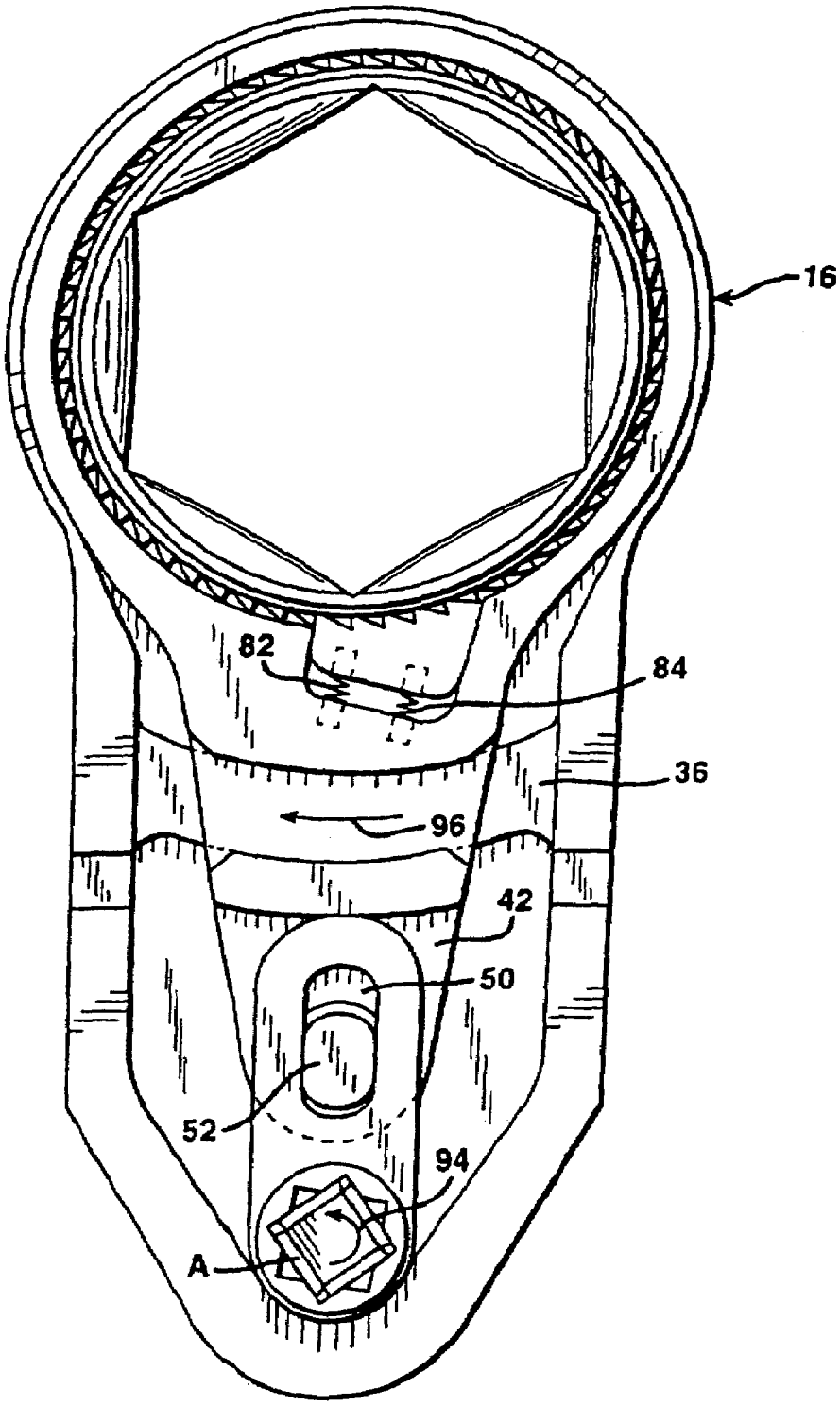
FIG. 4 is a top plan view of elements shown in the view of FIG. 3 coacting for a torque conversion stroke.

The input A is turned as indicated by the arrow 94 shown in FIG. 4. The rotation is in, for example, a counter clockwise direction. Accordingly, the drive finger 40 is also urged to pivot in a counter clockwise direction. The driven arm 42 is urged to move in a direction of arrow 96, while the pin 52 moves along the oblong-shaped aperture 50 of the drive finger 40.

The arcuate guide bar 36 extending upward from the bottom 32 of the plate 16 provides a stress point for the drive finger 40 and the driven arm 42. That is, as the finger and arm 40,42 respectively, are pivoted, there is a tendency for the finger 40 and arm 42 to be forced away from each other which would, but for presence of the guide bar 36, cause a detrimental amount of force to be incurred by the continuous side wall 20 of the plate 16. The guide bar 36 restricts the "parting" of the linkage assembly 38 and channels the stress and forces which occur during the torque operation to a more central location of the plate 16. Such forces are disbursed so that the structural integrity of the halves 14, 16, and therefore the housing 12, is not compromised.

Figure 5:
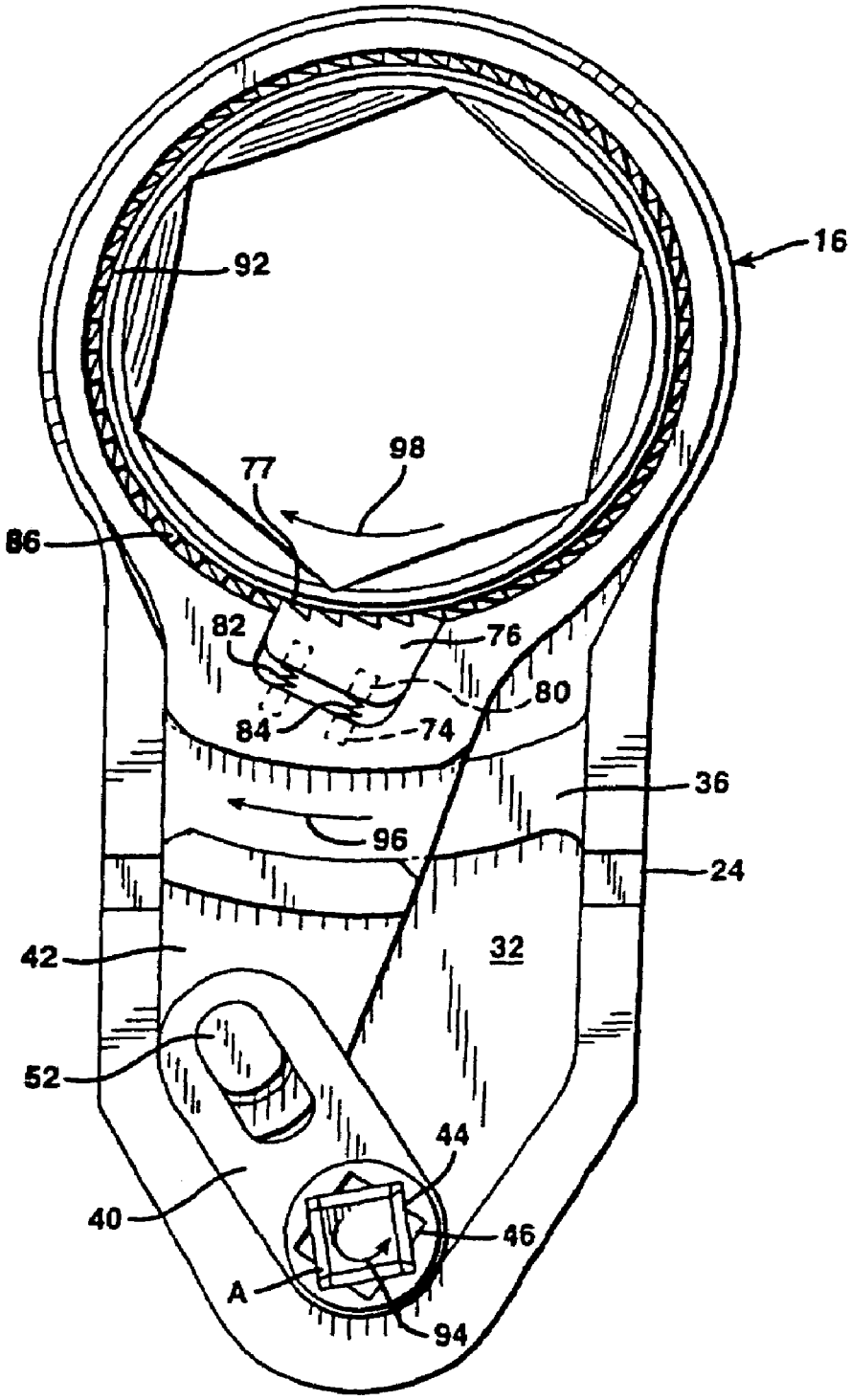
FIG. 5 is a top plan view of the hand wrench of FIG. 4 completing the stroke.

As the linkage assembly 38 is pivoted, the inclined teeth 77 of the pawl 76 engage the corresponding inclined teeth 86 of the ratchet 88. This motion forces the hex socket 90 to pivot as indicated by arrow 98 in FIG. 5 to tighten down the bolt B. The springs 82,84 as shown in FIGS. 4–5, bias the pawl 76 toward the ratchet 88 for engagement of the teeth 77,86. The motion of the linkage assembly 38 is therefore imported to the hex socket 90 to allow effective motion only in the direction as indicated by the arrow 98.

When the "throw" of the linkage assembly 38 is complete, as shown in FIG. 5, the input A is moved in the opposite direction, i.e. clockwise, to return the linkage assembly 38 for another torque operation. This movement permits the inclined teeth 77 of the pawl 76 to ride over the inclined teeth 86 of the ratchet so that the mechanism can be reset as in FIG. 3 for another torque cycle.

Figure 6:
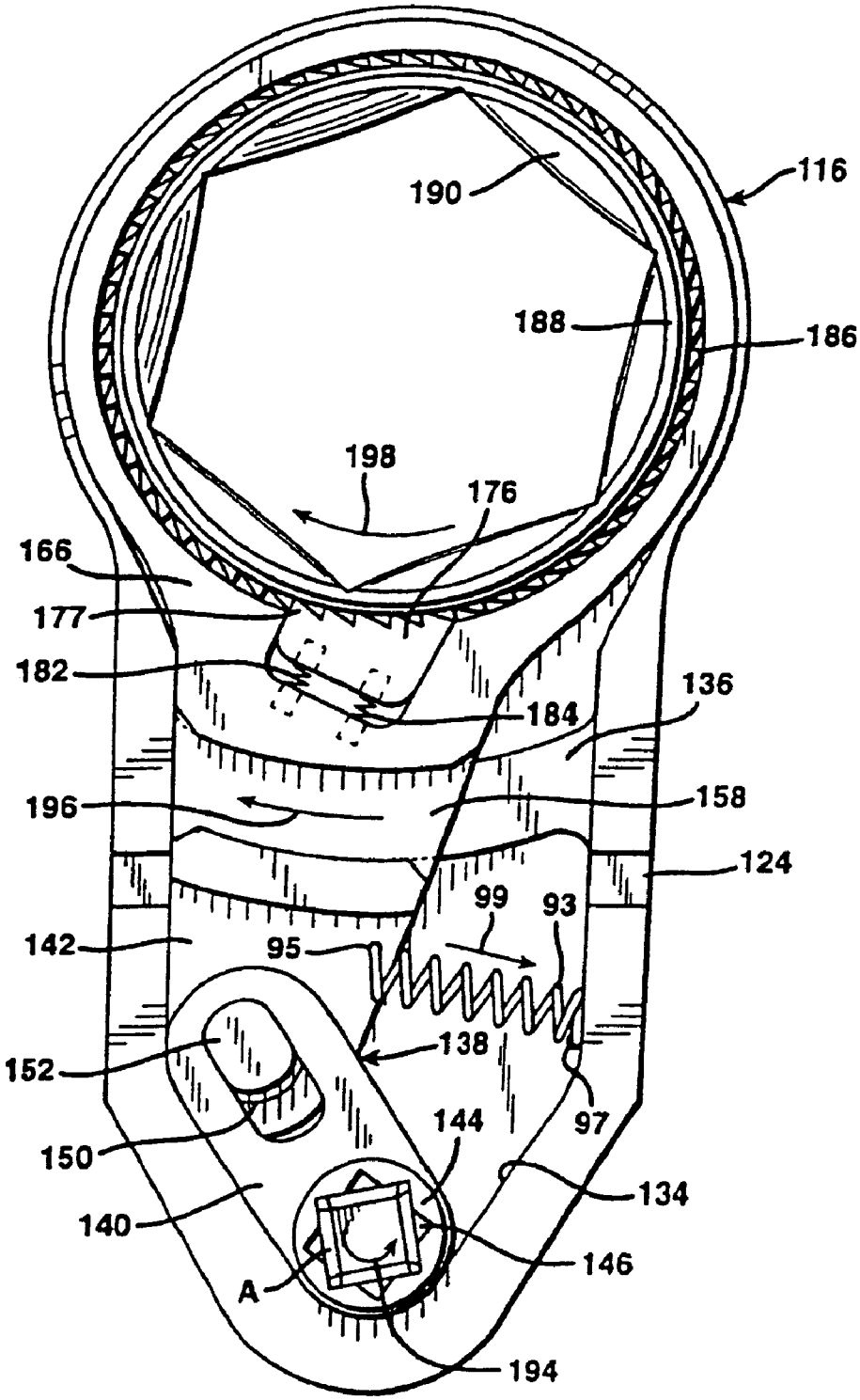
FIG. 6 is a top plan view showing elements of another embodiment of the hand wrench according to the present invention.

Another embodiment of an augmenter 110 constructed in accordance with the present invention is illustrated at FIG. 6. Elements illustrated in FIG. 6 which correspond to elements described above with respect to FIGS. 1–5 have been designated by corresponding reference numerals increased by 100. The embodiment of FIG. 6 is designed for use in a manner similar to that shown with respect to the embodiment of FIGS. 1–5, unless otherwise stated.

Referring now to FIG. 6, an additional biasing element 93 is shown. The biasing element 93 can be an extension spring, as shown in FIG. 6, or a torsion spring. In the example shown, the extension spring 93 has one end 95 connected to the driven arm 142, and an opposite end 97 connected to the continuous side wall 120 of the plate 116. The spring 93 inherently biases the linkage assembly 138 in a direction of arrow 99 to facilitate the return of the linkage assembly 138 to the starting position after the "throw" of the linkage assembly 138 is complete.

The construction and coaction of the drive finger 140 and the driven arm 142 of the linkage assembly 138 is such that a pair of springs 93 can be employed. That is, in addition to the spring 93, another spring (not shown), or a plurality of springs can be attached to the driven arm 142 at an opposite side to which the spring 93 is attached, and then to a corresponding portion of the side wall 120 to facilitate movement of the linkage assembly 138 in either direction.

The augmenter 110 is not limited to having only an extension spring such as that shown in FIG. 6. The device can be constructed with a combination of extension springs and torsion springs to operate as the biasing element 93.

It is preferred to mount the biasing element 93 as shown, as this position is proximate to the region of pivotal coaction between the drive finger 140 and the driven arm 142, thereby most effectively using the biasing force of the spring 93.

Figure 7:
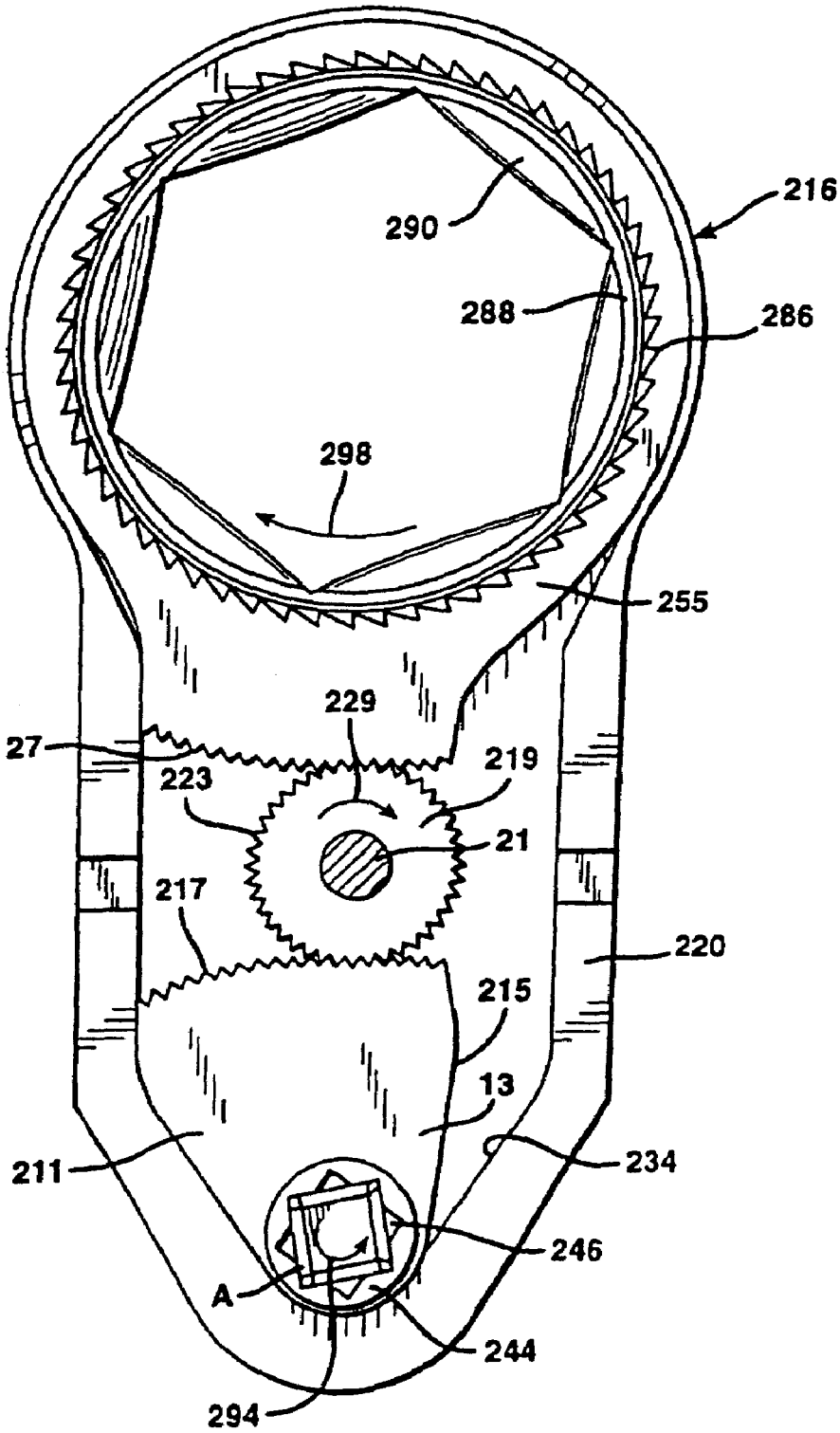
FIG. 7 is a top plan view showing elements of still another embodiment of the hand wrench according to the present invention.

Another embodiment of an augmenter 210 constructed in accordance with the present invention is illustrated at FIG. 7. Elements illustrated FIG. 7. which correspond to elements described above with respect FIGS. 1–5 have been designated by corresponding reference numerals increased by 200. The embodiment of FIG. 7 is designed for use in a manner similar to that shown with respect to the embodiment of FIGS. 1–5, unless otherwise stated.

In FIG. 7, a drive finger 211 has a first end from which a cylindrical portion 244 extends. The cylindrical portion 244 is provided with a hex or other multi-sided aperture extending completely therethrough. The half 216 is similarly provided with an aperture which is in registration with the aperture 246 of the half 214, such that when the halves 214, 216 are mated, the multi-sided aperture 246 of the drive finger 211 is accessible from an exterior of the half 214. This permits the user to extend the drive input A completely through the housing regardless of the length of the input A. The drive finger 211 is constructed with a side wall generally shown at 13 which substantially conforms to the shape of the upstanding side wall 220 of the half 216.

As shown in FIG. 7, a side wall 215 of the drive finger 211 is constructed to rest against the complimentary shaped side wall 220 extending from the half 216. This permits the drive finger 211 to pivot in position and rest against an inner surface 234 of the side wall 220.

An opposite end of the drive finger 211 is formed with a rack of teeth shown generally at 217. The rack 217 extends completely along this end of the drive finger 211 and is of a particular thickness and pitch for coaction with other elements of this embodiment as discussed below.

A transfer gear 219 is disposed for pivotal movement between the halves 214, 216. The transfer gear 219 is mounted to the half 216 by a pin 221. A plurality of teeth 223 extend along a peripheral edge of the gear 219, which teeth 223 are constructed and arranged for releasable mating engagement and contact between corresponding teeth 217 on the drive finger 211. During a torque operation, at least three or four, and preferably five of the teeth 217,223 on the drive finger 211 and the transfer gear 219, respectively, are in contact to provide strength and stability during the torque operation.

The driven arm 225 in FIG. 7 is provided with a rack of teeth 227 extending along a peripheral edge of a portion thereof. The pitch of the teeth on the rack 227 of the driven arm 225 is equal to the pitch on the teeth 217 on the driven arm 211. The rack of teeth 227 is of a thickness and pitch to facilitate releasable mating contact with the teeth 223 of the transfer gear 219. At least three or four, and preferably five teeth of the transfer gear 219 and driven arm 225 mesh during a torque operation to facilitate strength and stability of the device during the operation.

Springs (not shown) can also be used with the embodiment of FIG. 7 to bias the drive finger 211 and driven arm 225 to their selective positions.

The embodiment of FIG. 7 operates as follows.

The drive input A is inserted into the aperture 246 and turned in the direction of arrow 294. The drive finger 211 is moved in a counter-clockwise direction with the teeth 217 thereof in engagement with the teeth 223 of the transfer gear 219. The transfer gear 219 in turn rotates in a clockwise direction as shown by the arrow 229. This motion of the transfer gear 219 causes the conversion plate 225 to move in a clockwise direction as indicated by the arrow 298 to impart a rotational movement to the teeth 286 of the ratchet 288. The hex socket 290 is also moved in a clockwise direction to turn the bolt or stud being tensioned. When the hex nut 290 has been turned down on the bolt or stud through a complete "throw" of the turning operation, the device is returned by the user in an opposite direction for the conversion plate to ride over the teeth 286 to prepare for a subsequent torquing operation during which the teeth 286 of the ratchet 288 are engaged to subsequently cause the hex nut 290 to tighten down the bolt.

The height of drive finger 211 and driven arm 225, in combination with locking means (not shown) for the housing function as a guide for 211,225.

The construction of the teeth used for the drive plate 211, transfer gear 219 and driven arm 225, are selected for gear backlash to be within tolerable limits so that slippage is reduced as much as possible upon reversal of the gear rotation.

As shown in FIGS. 1–5, the wrench with augmenting device can be used as a simple hand wrench tool to either tighten or loosen nuts to another fastener. The socket of the wrench is fitted over the item to be loosened or tightened in the same manner that a ratchet type socket wrench would be fitted over any standard item to be wrenched. Note that nesting sockets (not shown but well known in the art) could be used to modify the size of the engaging socket in order to give the tool a wider range of operative use. The tool also has a relatively narrow rim between the socket and the outer edge of the tool surrounding the socket. This enables the tool to be placed into relatively narrow areas which is often the case with bolting circles and other areas which provide limited access for the worker. The tool is then operated as a standard ratchet socket wrench. The handle is rotated about the socket to loosen or tighten the item that is to be wrenched. In an instance where a high torque is necessary; either to "break" or dislodge a nut or other fastener which tends to become frozen in place, or to "snug up" the item to be tightened when it is no longer possible to easily move the handle of the wrench, then the augmenting feature of the wrench is employed. A mating drive fits into the drive socket or receptacle in the bottom of the handle. This drive implement can be a relatively long bar or it can be connected to the output drive of a mechanical or pneumatic device. The auxiliary drive member is then actuated to rotate the driven socket in the handle, which actuates the linkage in the handle of the wrench to rotate the socket through a limited angle as discussed. This limited angle will be sufficient to tighten or loosen the item that is being acted upon by the wrench. If it turns out that the linkage in the handle of the wrench has "stopped out" or run its full travel without reaching the desired level of torque being applied by the actuating socket of the wrench then the auxiliary torque apparatus can be reversed. The rachet feature of the wrench, will allow the linkage within the handle to return to the initial position. The auxiliary torque apparatus does not have to be removed from the drive socket at the bottom of the handle, but merely rotated in a direction opposite to the force applying direction because the ratchet feature will allow the linkage within the handle to return to its initial position.

The wrench of course can be used to tighten or loosen, merely by turning the wrench over, and using one face for turning in a clockwise direction and the other face for turning in a counter clock-wise direction. As shown in FIGS. 2–5, the front and back halves of the housing have ridges which coact with and guide the grooves in the driven arm of the linkage over a relatively wide area. Additionally, the sides of the driven arm are shaped to conform with or abut the interior side walls of the linkage along a long length of the driven arm. This will tend to dissipate the force that will be applied to the housing by the linkage when the linkage is "stopped out" at the end of its travel. Similarly, the pin arrangement and slotted drive finger allow for relatively wide contact surfaces to minimize wear. The ridges or raised portions on the driven arm which surround the rachet at the lower end which form the groove for the ridges from the housing act as a stiffening member when the pieces are assembled to provide strength for the handle making the tool relatively rugged but still operable.

The ratchet and socket arrangement is relatively simple and reliable, and the wear features of the construction insure not only that the life of the tool will be relatively long, but its operation will be relatively easy.

Shown in FIG. 6 are a variety of springs which can also be used to bias the driven arm of the apparatus. The springs can be compression springs or torsion springs.

As shown in FIG. 7, the apparatus can also be built in a variety of ways such as by use of an idler gear between two gear racks, which replaces the linkage.

Figure 8:
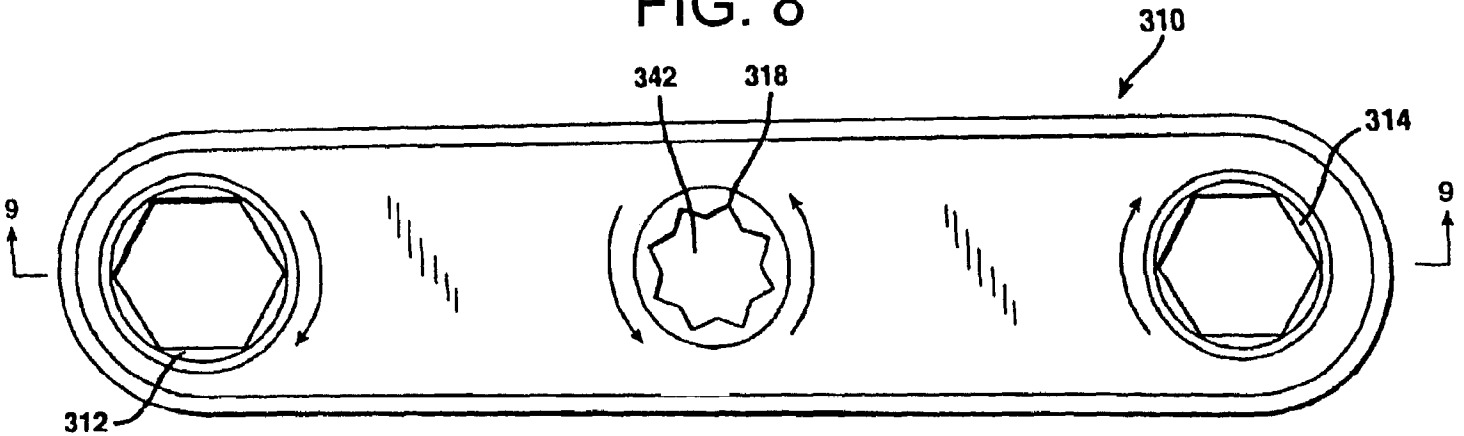
FIG. 8 is a top view of another embodiment of a wrench with torque augmenting means known in the art.
Figure 9:
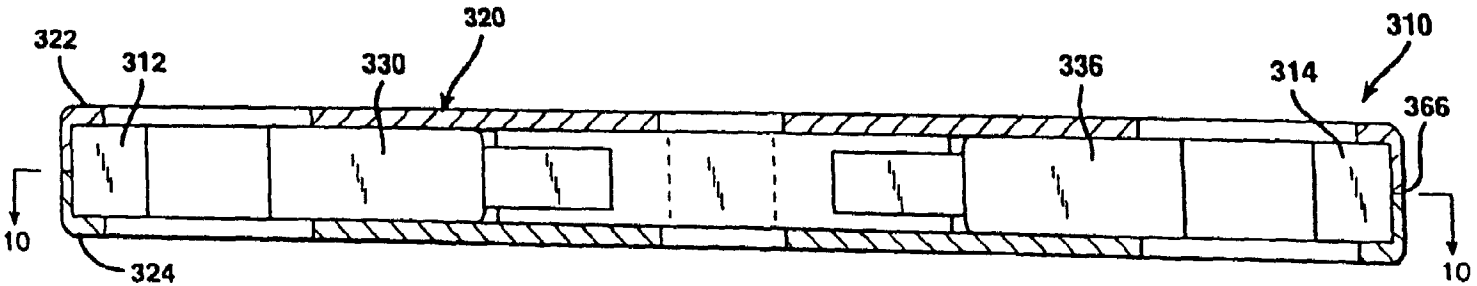
FIG. 9 is a side view taken along line 9—9 of FIG. 8.
Figure 10:
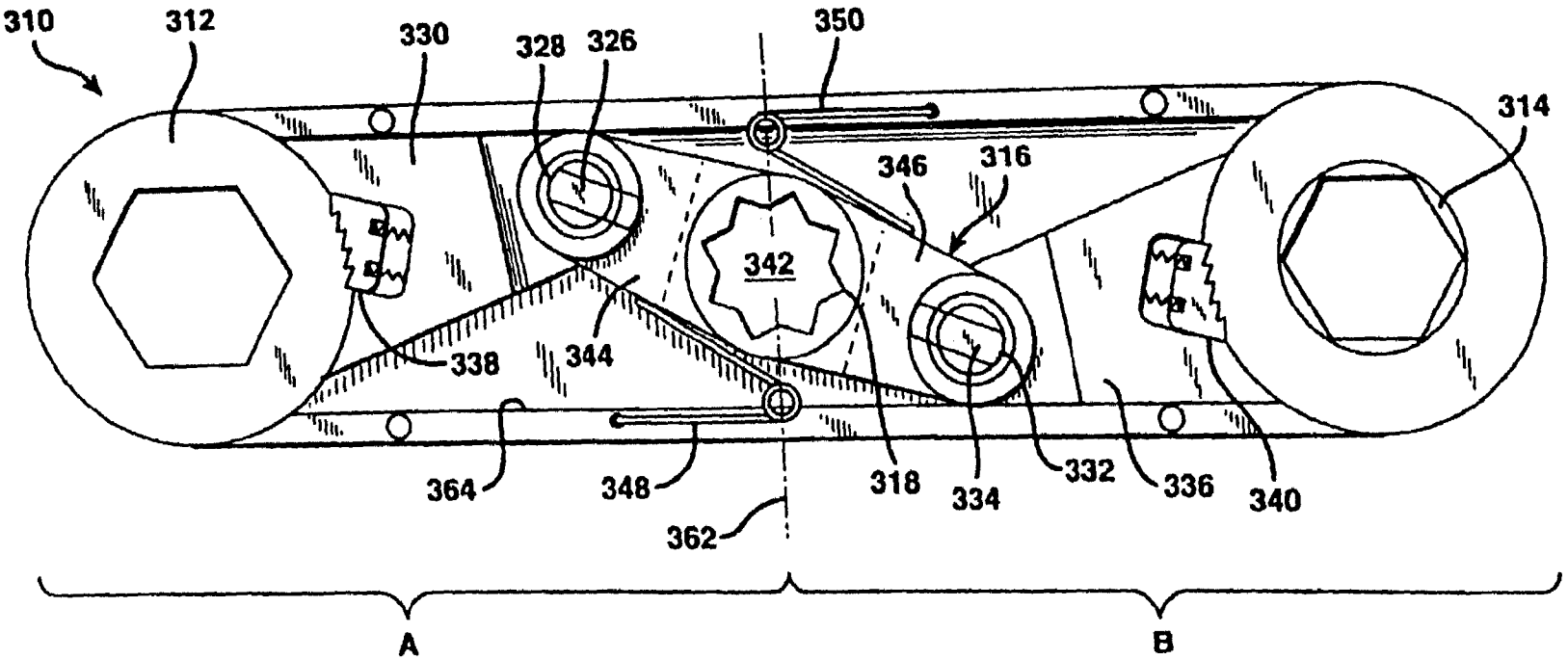
FIG. 10 is a view taken along line 10—10 of FIG. 9.

Referring to FIGS. 8–10, there is shown another embodiment of the invention at 310 having a symmetrical arrangement in which a pair of drive sockets 312,314 are provided, each driven from a link 316 connected to the driven middle socket 318. The drive sockets 312,314 and link 316, as well as other elements of this embodiment discussed below, are disposed in a housing 320 for the augmenter 310 consisting of releasably engagable halves 322,324. The same form of linkage shown in FIGS. 2–6 is present in the augmenter 310, with the oval pin 326 rising in slot 328 in the driven arm 330 of region A, and oval pin 332 rising in slot 334 from the driven arm 336 in region B. A similarly constructed ratchet and pawl arrangement 338,340 is used with respect to each of the drive sockets 312,314 at each end of the wrench. Driving the driven aperture 342 of the socket 318 will cause rotation of the link 316 with the opposing drive arms 344,346. The drive fingers 344,346 rotate the driven arms 344,346 to rotate the adjacent ratchet assemblies 338,340 until the driven arms 330,336 abut a respective opposed side of the housing 320 along the length of the arms 330,336.

The driven or middle link 316 has torsion springs 348,350 on either side attached to the adjacent wall of the housing. The springs 348,350 each slide as the middle link is rotated, and tend to urge the middle link 316 into the initial position as shown in the drawing.

Figure 11:
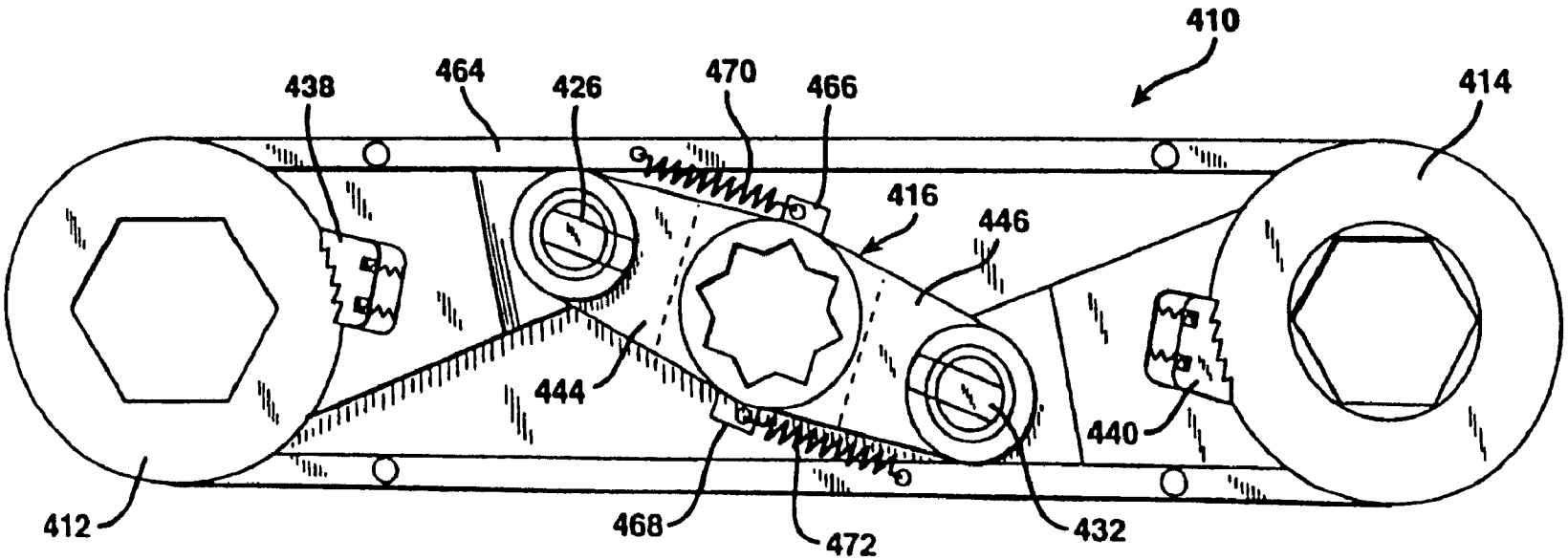
FIG. 11 is another embodiment of the invention similar to the view shown in FIG. 10.
Figure 13:
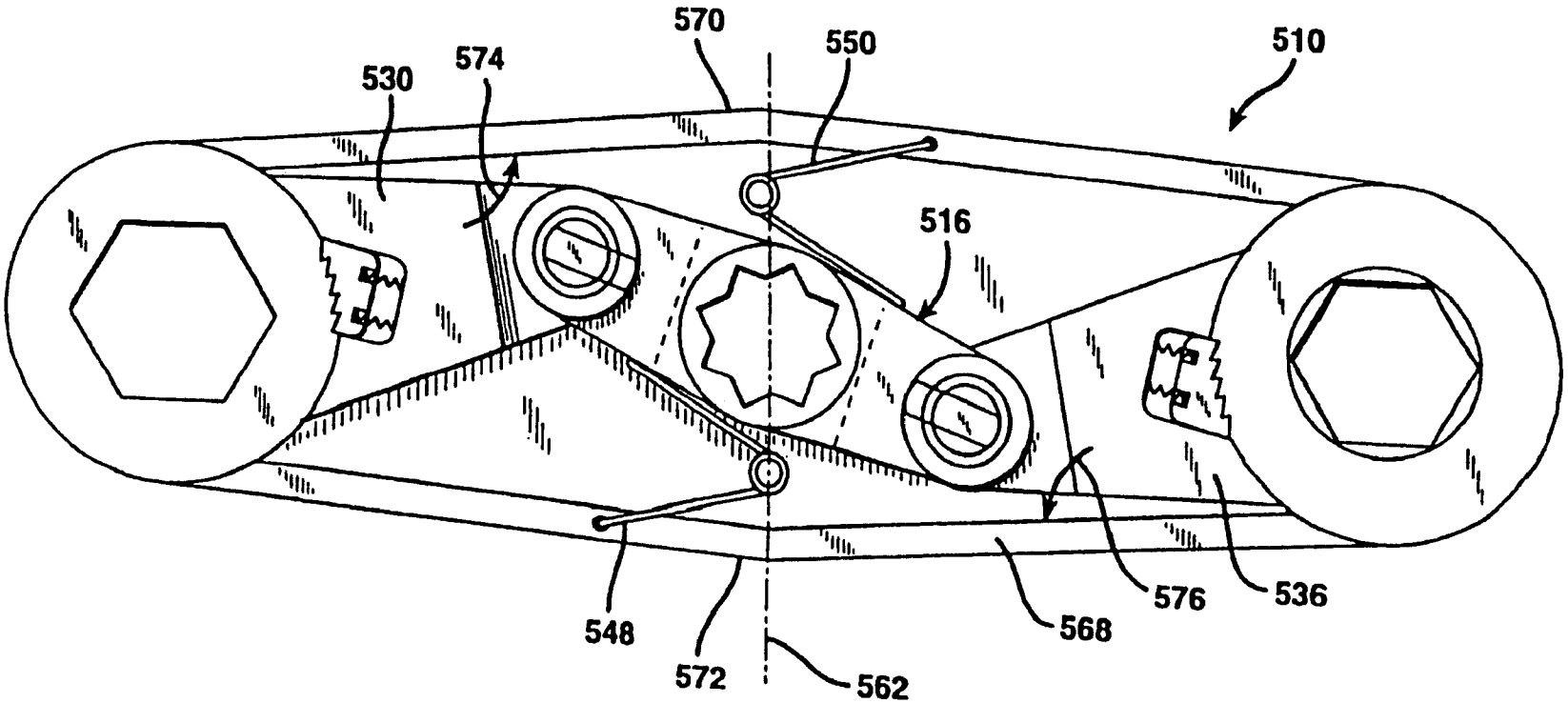
FIG. 13 is a view of another embodiment of a wrench with torque augmenting means known in the art similar to the view shown in FIG. 10.

The various guides, slots and grooves that are shown in FIGS. 1–7 on the front and back walls of the housing, and on the driven arms of the apparatus can also be included in the structure of the embodiment shown in FIGS. 8–10, and the embodiment shown in FIGS. 11 and 13.

While the augmenter 310 is shown having parallel sides and is relatively symmetrical, these dimensions will vary depending upon the size of the drive sockets 312,314 at either end of the device and the intended use of the tool.

If, for example, it is desired to have a longer throw for each cycle of the augmenter 310, then the central portion of the tool between the drive sockets 312,314 can be widened as shown and discussed with respect to FIG. 13. This will provide a longer distance for the driven arms 330,336 to travel and therefore, increase the angle for each cycle.

Additionally, the size of the drive sockets can vary from less than an inch to more than 9 inches to accommodate nuts which fasten to studs of 6" or more in length.

Figure 12:
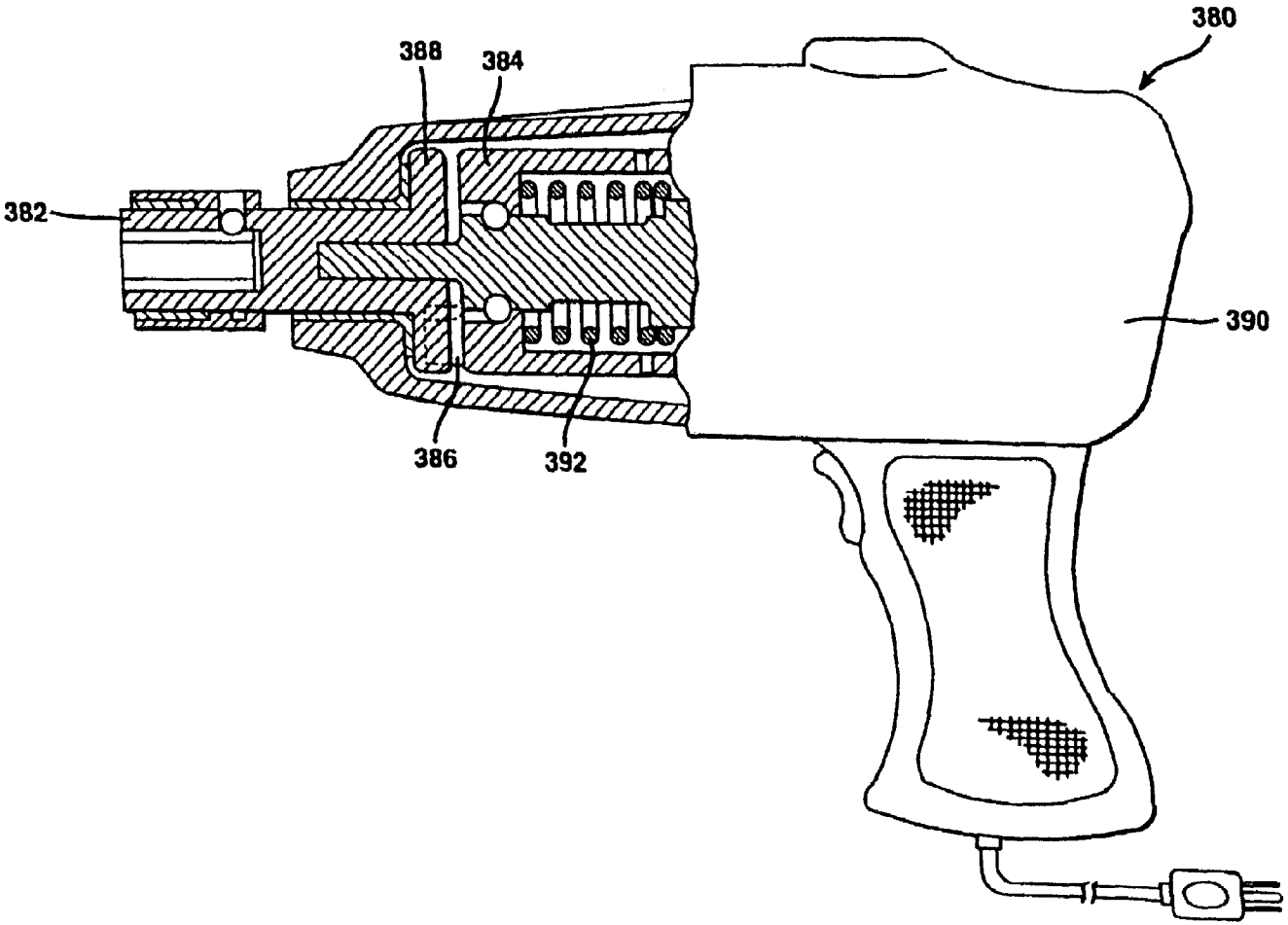
FIG. 12 is a cross-sectional view of an impact wrench known in the art.

The system is well suited for use with external torquing devices, such as a commonly available impact wrench 380 shown in FIG. 12. This impact wrench 380 has a transmitting end 382 which is driven by a slide collar 384, that will oscillate back and forth, to engage and disengage the finger 386 extending from the collar to ride on camming surface 388 connected to the transmitting end 382. When the torque exerted by a motor 390 is sufficiently high to cause the torque level adjusting spring 392 to retract, the engaging finger 386 will ride up the cam surface 388 to a point such that the spring 392 is compressed sufficiently to enable the finger 386 to disengage from the camming surface 388 and allow the device to rotate internally without externally rotating the transmitting end of the device. By inserting the transmitting end of the impact wrench into the driven socket 318 at the middle of the augmenter 310, the drive link 316 will rotate the drive fingers 344,346.

The housing halves 322,324 are joined together as shown in FIG. 9. A gasket 366 is interposed between the halves to seal a lubricant, such as grease for the elements, within the augmenter 310. The gasket can be formed by filling corresponding grooves in the mating surfaces of the housing with a substance that will cure to form a gasket.

There is a coaction between the internal spring of the impact wrench which causes the periodic application of torque, and the internal springs 348,350 connected to the link 316. The impact wrench produces an increase in torque and rotation until disengagement occurs between the drive finger and the camming surface. During movement of the impact wrench, the driven or middle link 316 of the augmenter 310 will move from the initial position as shown in FIG. 10 to a position at the opposite end of its travel against the other wall. When the spring of the impact wrench causes disengagement, the torque asserted is suddenly substantially reduced and the spring arrangement 348,350 of the augmenter will then cause the middle link 316 to rotate to the initial position shown in FIG. 10, bringing each one of the driven arms 330,336 up flush against a respective side of the inner wall 364 of the housing.

As the collar of the impact wrench 352 rotates in the direction of the arrows surrounding middle aperture 342, or in a counter-clockwise direction, the driven arm will rotate in the clockwise direction to rotate the driven socket 318 until the opposite side of the driven arm abuts the inner wall 364 of the housing.

To use the augmenter 310 to remove a fastener, the augmenter is turned over so that the angles are reversed and the direction of the impact wrench is also reversed.

As shown in FIGS. 9 and 10, the elements for the augmenter 310 are symmetrical about the central transverse axis 362. Regions A and B of the augmenter 310 at opposed sides of the axis 362 include elements which function in a symmetrical manner of operation. This provides for even torque augmentation during cycling and recycling, and relatively equal amounts of stress and wear upon the operable elements of the device.

FIG. 11 shows another embodiment of the augmenter invention shown generally at 410, in which a middle link 416 has two ears 466,468, which are used to connect compression springs 470,472, respectively, to the sidewall 464 of the housing. The compression springs 470,472 function in the same manner as the torsion springs 348,350 shown in FIG. 10, i.e. the function to position the middle link 416 to one extreme position to urge the driven arms 444,446 abutted against the wall 464.

FIG. 13 shows still another embodiment of the augmenter invention according to the present invention and shown generally at 510. In this embodiment, a sidewall 568 of the augmenter 510 is bowed or widened at opposed sides shown generally at 570,572, with the apex of each widened portion occurring at approximately the transverse axis 562 of the housing for the augmenter 510. As with the embodiments in FIGS. 8–11, elements of this embodiment of the augmenter 510 are symmetrical at opposed sides of the axis 562. The widening of the sidewall 568 of the housing provides for an increased throw of the central link 516 so that the respective driven arms 530,536 will proceed along the direction of the arrows 574,576, respectively, wherein the arms 530,536 abut a corresponding region of the sidewall 568. Because the arms 530,536 have to travel further for abutment with the sidewall 568, there is an increase in throw over that which is provided with the embodiments at FIGS. 8–11.

Accordingly, from the above description, the mechanical advantage that is imparted by means of the augmenter wrench can be varied depending upon the relative lengths of the driven arms and the drive fingers engaging the driven arms. An equal length of the driven arms in relation to the drive fingers will produce a neutral mechanical advantage. A positive mechanical advantage will result if the lever arm of the drive finger is longer than the lever arm of the driven arm and vice versa, if it is shorter. In the Figures, the drive finger is shown shorter than the driven arm thereby reducing the torque provided to the drive sockets below the torque provided to the middle driven socket.

The device of the present invention not only can act as a effective tool for manually tightening a fastener up to a certain extent, but the device offers significant advantages when working with an impact tool in confined spaces or spaces having relatively low clearance. The device is relatively narrow at the drive socket to fit over a bolt, or for a socket to be placed within the drive aperture to engage a nut. When the impact tool engaged with the augmenter relaxes, or there is a lull in the torque cycle, the internal springs of the augmenter will force the driven arm to the extreme initial position and the cycle will repeat itself. The combination of the impact tool and the augmenting wrench will continue to cycle until the torque necessary to rotate the driven arm is greater than the torque that is exerted by the impact wrench. In effect, the device dead ends when the pressure of the spring on the drive collar will be insufficient to rotate the driven arm of the augmenter.

A drive arm is mounted for coaction with the ratchet and has a somewhat triangular shape extending toward a more central portion of the housing.

The distance between the drive socket and the driven aperture affords clearance so that an impact tool such as shown in FIG. 12, can be applied to the augmenter at a substantial offset distance from the fastener acted upon.

A continuous gasket extends along the surface area of each one of the halves where the halves contact each other to form the housing. The elements described with respect to FIGS. 8–11 are bathed in grease to provide lubrication and cooling during the highly repetitious movement of the elements when being driven by the impact wrench.

The movement of the impact wrench in the drive receptacle causes each one of the sockets to move in an opposite direction in the ratio of the lever arms. That is, the sockets will rotate at the opposite ratio of the mechanical advantage.

Figure 14:
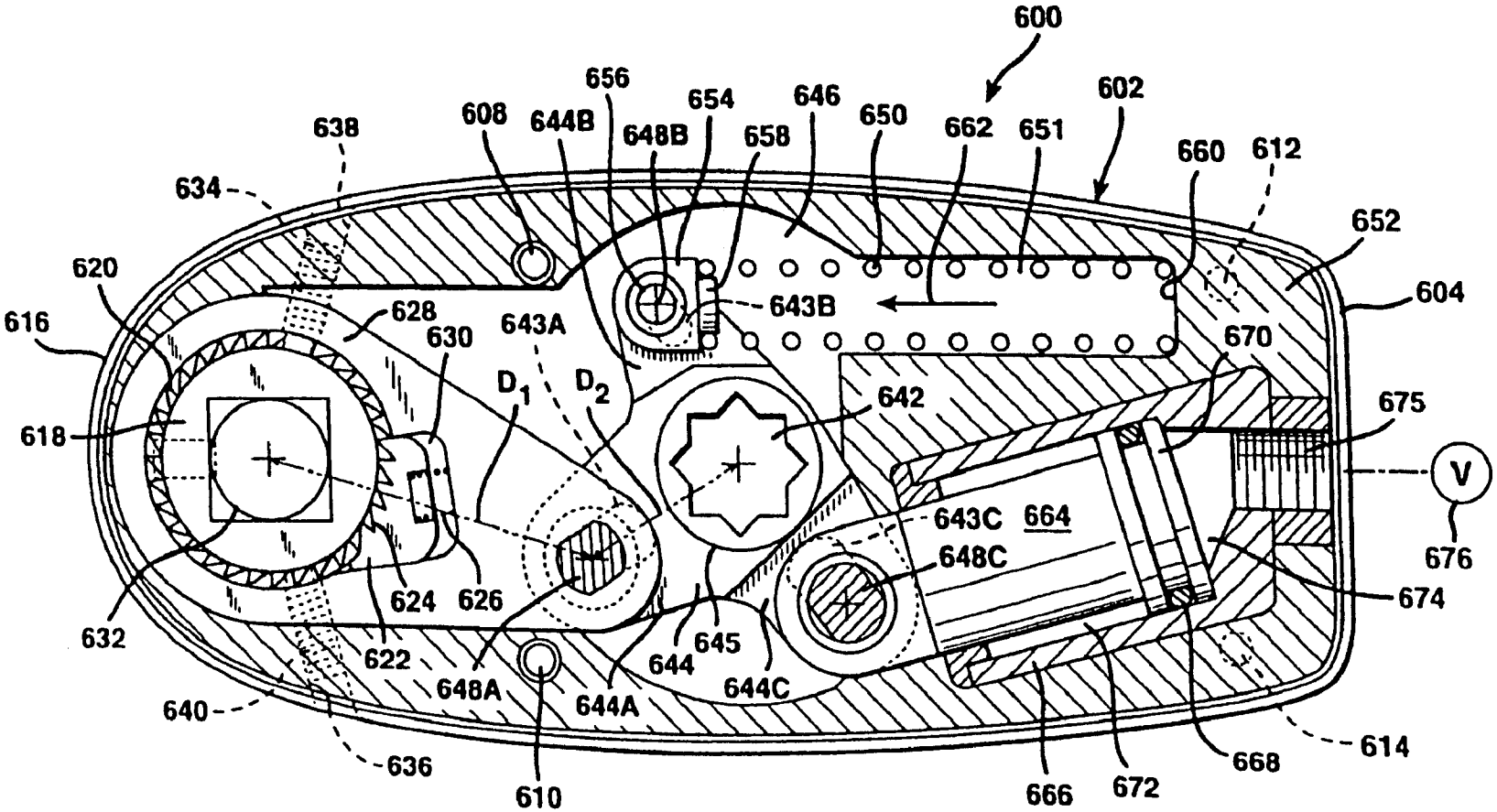
FIG. 14 is a top plan view showing an interior of another embodiment of a wrench with torque augmenting means known in the art.

In FIG. 14, another embodiment of a wrench having torque augmenting means is shown generally at 600. The housing 602 for the wrench is formed of two halves 604,606 (see also FIG. 17) for the bottom and top, respectively, which are held together with case screws positioned at 608–614. For reference purposes, a front end 616 of the wrench includes a ratchet 618 with teeth 620 and a pawl 622 with corresponding engaging teeth 624 mounted for coaction with each other. The pawl 622 is biased for coaction with the ratchet 68 by a spring 626. The pawl 622 and spring 626 are supported on a drive or lever arm 628 formed with a recess 630 to receive the pawl 622 and spring 626. The pawl and spring are adapted for coaction with the ratchet 618 during a torque operation. A drive or torque output 632 for this embodiment can be either a male drive element or a female drive element such as a socket.

The housing 602 is provided with at least one, and in a preferred construction, a pair of threaded bores 634,636 in each of which is inserted a corresponding pair of friction control screws 638,640 of this drag means for providing "drag" upon the ratchet 618. The friction control screws 638,640 of this drag means prevent the ratchet 618 from losing the initial torque obtained at the very beginning of a torque operation.

A drive or power input 642 is disposed substantially at a center of the housing 602. The drive input 642 is adapted to receive a female member such as a socket, or can be fitted with an adapter to extend therefrom and receive the female drive member.

A linking means 644 such as a reaction arm having three lobes 644A–C or ears is mounted to a circular bushing 645 supported at the drive input. The linking arm 644 turns at the bushing 645 in conjunction with movement of the drive input 642. A bottom floor 646 of the casing 602 is constructed and arranged to provide for movement of the linking arm 644 within the casing 602.

The drive output 632 and the drive input 642 are accessible from either side of the casing 602.

A connecting means such as a first pin 648A connects the first lobe 644A or transmission lobe of the linking arm 644 with the lever arm 628. A second pin 648B connects the second ear 644B or return lobe of the linking arm 644 to a compression spring 650 mounted in a receptacle 651 at an end 652 of the housing 602 substantially opposed to the end 616 of the housing in which the torque output 632 is arranged. The compression spring 650 includes a mounting plate 654 having an aperture 656 therethrough which is constructed and arranged to receive the second pin 648B and permit the second pin 648B to move during pivoting of the linking arm 644. A support stud 658 extends from the mounting plate 654 and is attached to an end of the compression spring 650. The opposite end of the compression spring, as mentioned above, is mounted at an interior of the housing 602 in the receptacle 651 as shown generally at 660. The compression spring 650 forces the linking arm 644 in the direction of arrow 662.

A third connecting means such as pin 648C connects a third one of the lobes 644C or power lobe of the linking arm 644 to piston means 664 or a plunger which extends into a cylinder 666 in the housing 602. A seal 668 extends around a head 670 of the piston 664.

A chamber 672 for the cylinder 666 is in communication with a passageway 674 leading to an inlet 675 which can be connected to a valve 676 or other hydraulic source/device external to the housing 602 for the wrench 600.

Slots 643A–C are provided for corresponding pins 648A–C to move therein during pivotal movement of the linking arm 644.

Figure 15:
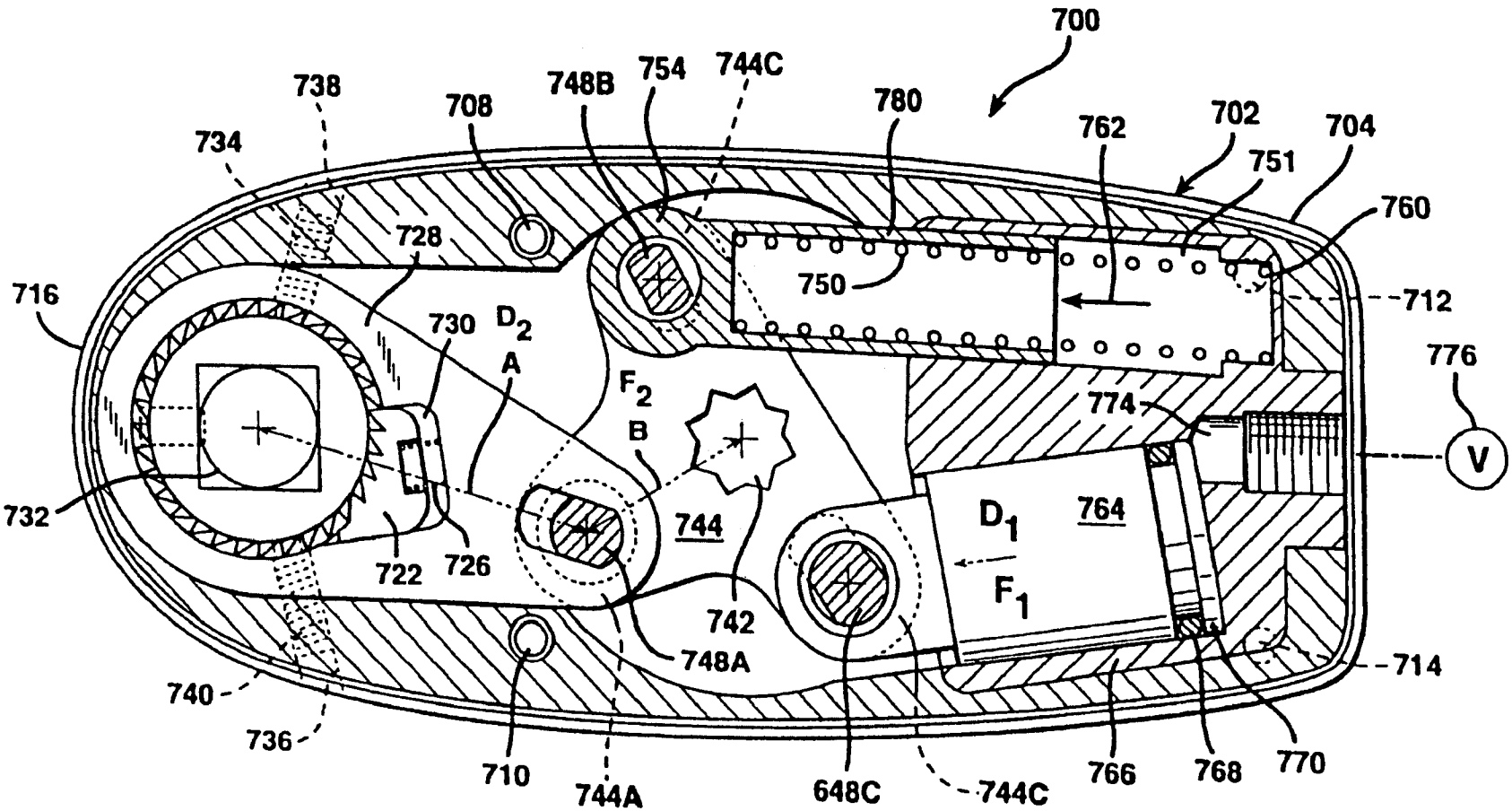
FIG. 15 is a top plan view showing an interior of still another embodiment of a wrench with torque augmenting means known in the art.

The arcuate guide bar 36, and ridges 62,66 and 64,67, and grooves 58,60 of FIGS. 2 and 3 can also be included in the embodiment shown in FIGS. 14–18, but are not shown in FIGS. 14–18 for purposes of clarity. These elements function similar to that disclosed and described with respect to FIGS. 2 and 3. In operation, the wrench 600 is used by inserting a drive member into the power input 642 and torquing the input to pivot the linking arm 644 in a clockwise direction. Referring also to FIG. 15, this motion will accordingly force the drive arm 642 in a counter clockwise direction thereby providing the torque and permitting the teeth 624 of the pawl 622 to engage the ratchet teeth 620 and retain the next advanced position with respect to the ratchet 618.

Alternatively, if an impact wrench 380, such as that shown in FIG. 12, is inserted into the power input 642 for the wrench 600 of the present invention, the repetitive cycling of the impact wrench 380 will provide the necessary torquing strokes. The spring 650 will force the linking arm 644 in a counter clockwise direction upon termination of each stroke during the lull or slip of the impact wrench 380.

The power input 642 can be bypassed in those instances where a hydraulic line is connected to the valve 676 of the wrench 600, thereby employing the piston 664 to force the linking arm 644 in a clockwise direction against the spring 650. After completion of the stroke of the linking arm 644, the brief interval of slip permits the spring 650 to bias the linking arm 644 in a counter clockwise direction to reset for a subsequent torquing stroke.

Torque output for the wrench shown in FIG. 14 is determined by the ratio of the distances D1 and D2. The 2:1 ratio corresponds to the distance indicated at D1 with respect to the distance at D2, thereby providing the 2:1 ratio for torque input to torque output.

Figure 16:
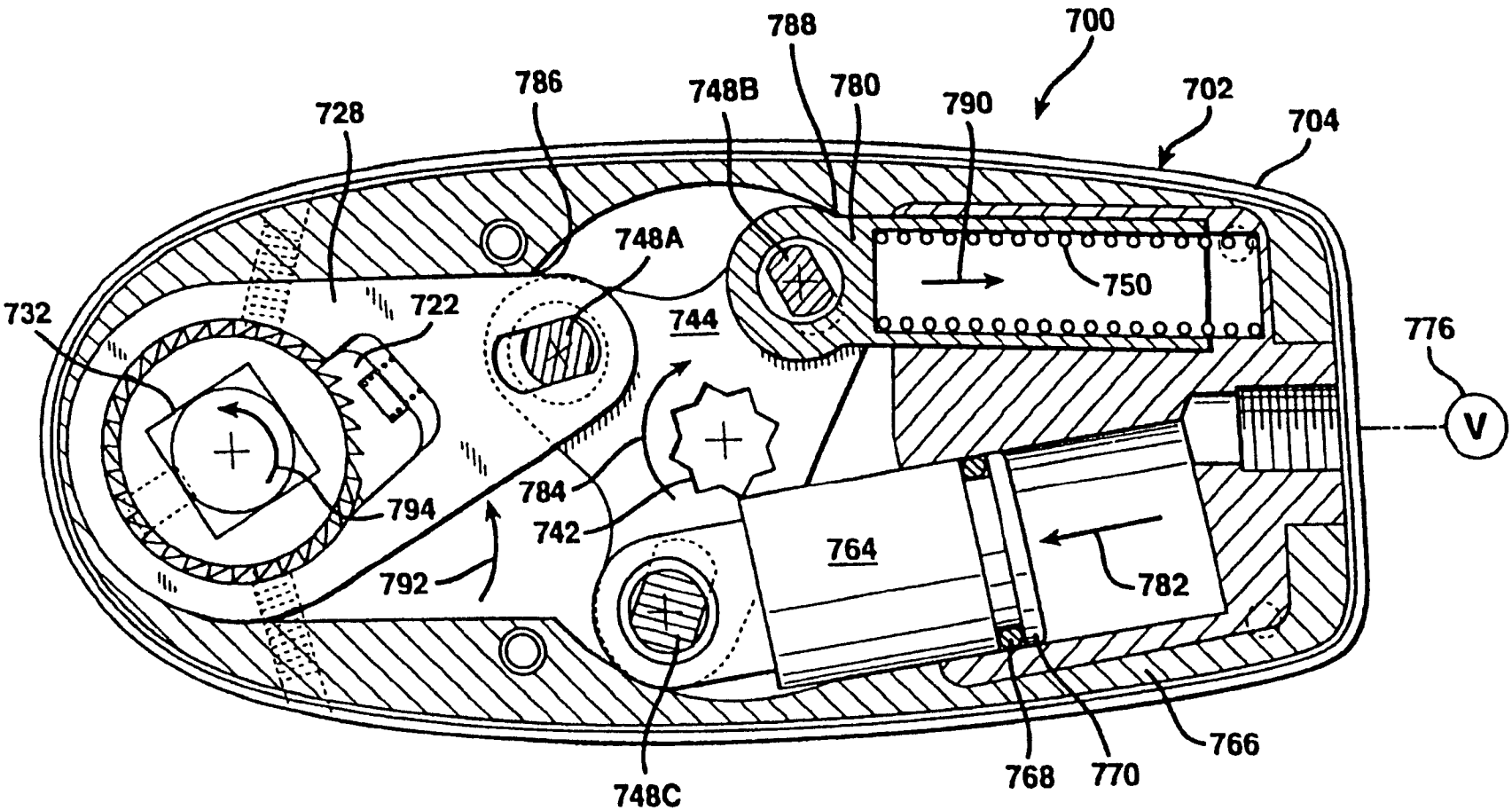
FIG. 16 is a top plan view of the embodiment shown in FIG. 15 upon conclusion of a torque stroke of the present invention.

In FIGS. 15 and 16, another embodiment of the wrench shown in FIG. 14 is disclosed. In this embodiment, the elements are referred to by numbers increased by 100 so that the wrench is shown generally at 700. All of the elements operate substantially the same as those disclosed in FIG. 14, unless otherwise stated. A cylinder 766 for the piston 764 is modified to receive and retain the spring 750. In this manner of construction, the spring 750, piston 764 and cylinder 766 are assembled as a unit in the housing 702 for the wrench 700.

The torque output provided by the wrench as shown in FIG. 15 is obtained from the formula, torque output=(F1×D1)÷(F2×D2) where:

F1 is the force applied at the piston 764;

D1 is the distance traveled by the piston 764;

F2 is the force applied to the reaction arm 744; and

D2 is the distance that the drive arm 728 travels.

In FIG. 15, the compression spring 750 is mounted at one end in the cylinder 766 at 760. An opposite end of the spring is received in a sleeve 780 or a collar which extends to the mounting plate 754 through which the second pin 748B is disposed. The construction of the spring 750 and piston 764 arranged in the same cylinder 766 provides for more stable torquing and recoiling operations, and a reduction in vibration under extreme pressures. FIGS. 15 and 16 show the beginning (FIG. 15) position of the wrench 700 according to the present invention as it proceeds through a first stroke (FIG. 16) just prior to the subsequent slip that would occur if used with an impact wrench (FIG. 12), or the return of a hand operated device at the power input 742 for another subsequent stroke of torquing force.

Referring to FIG. 16 in conjunction with FIG. 15, there is shown movement of the piston 764 in the direction of arrow 782 to force the linking arm 744 in the direction of arrow 784. As the linking arm turns clockwise all the way to the stops 786,788, the sleeve 780 is forced in the direction of the arrow 790 so that the spring 750 is compressed in the cylinder 766. During the pivoting of linking arm 744, it can be seen that the drive arm 728 is pivoted in the direction of the arrow 792 until the drive arm 728 contacts the stop 786 in the housing 702. As the drive arm 728 turns, the teeth 724 of the pawl 722 are biased into engagement with the teeth 720 of the ratchet 718 to provide for a torque stroke at the drive output 732. Accordingly, the drive output 732 turns in the direction of the arrow 794.

Figure 17:
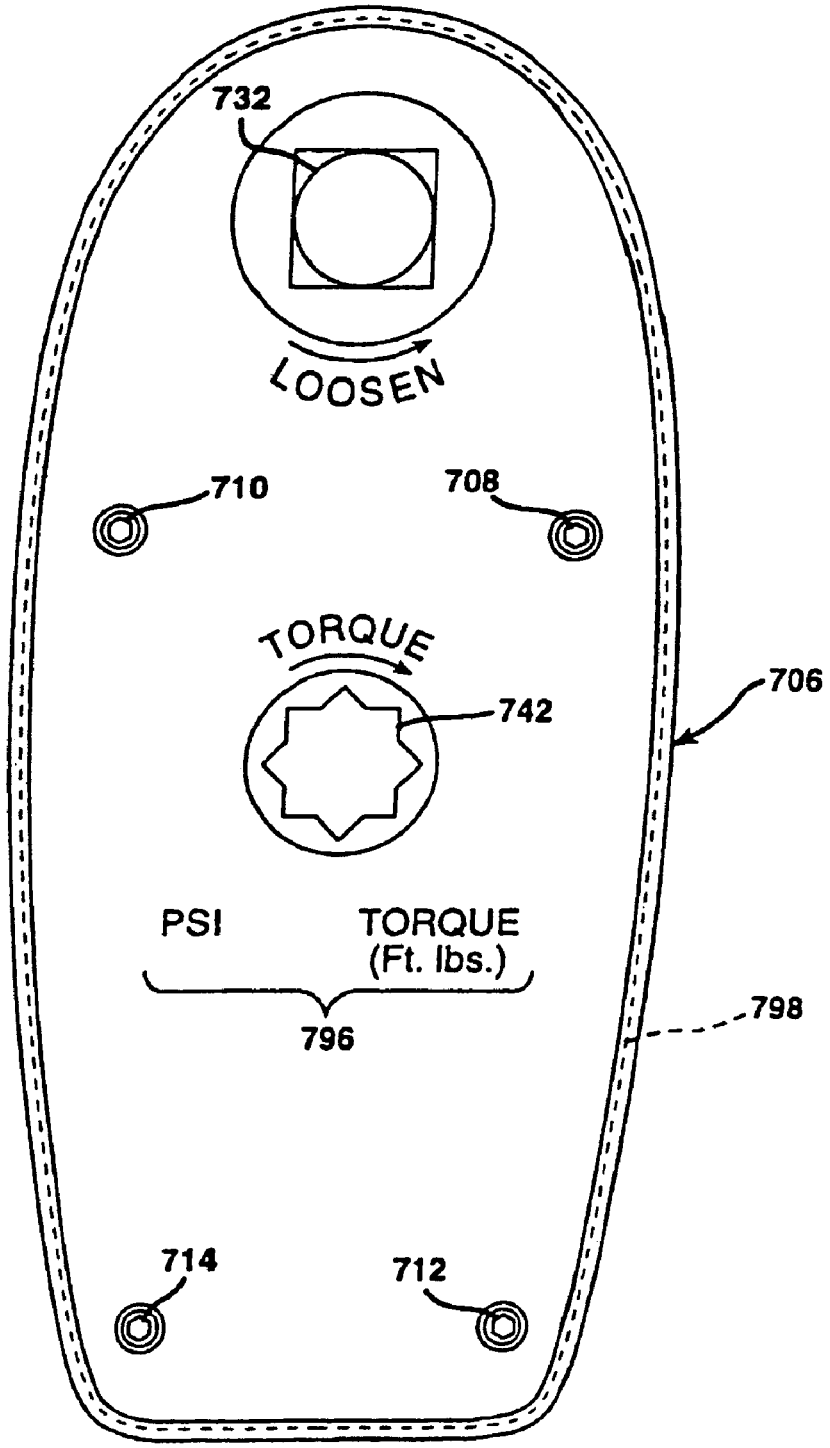
FIG. 17 is a top plan view of a cover for a casing for the embodiments shown in FIGS. 14–16.

FIG. 17 shows a cover 706 or the other half of the housing 702 for the wrench 700 shown in FIGS. 15 and 16. This cover 706 can also be used with the embodiment shown in FIG. 14. A legend or table of the relationship of the PSI and TORQUE (foot lbs.) is shown generally at 796 and is provided on the cover for purposes of cross-referencing during the torque operation. A broken line 798 indicates the position of a gasket used when the halves of the housing are joined together.

Figure 18:
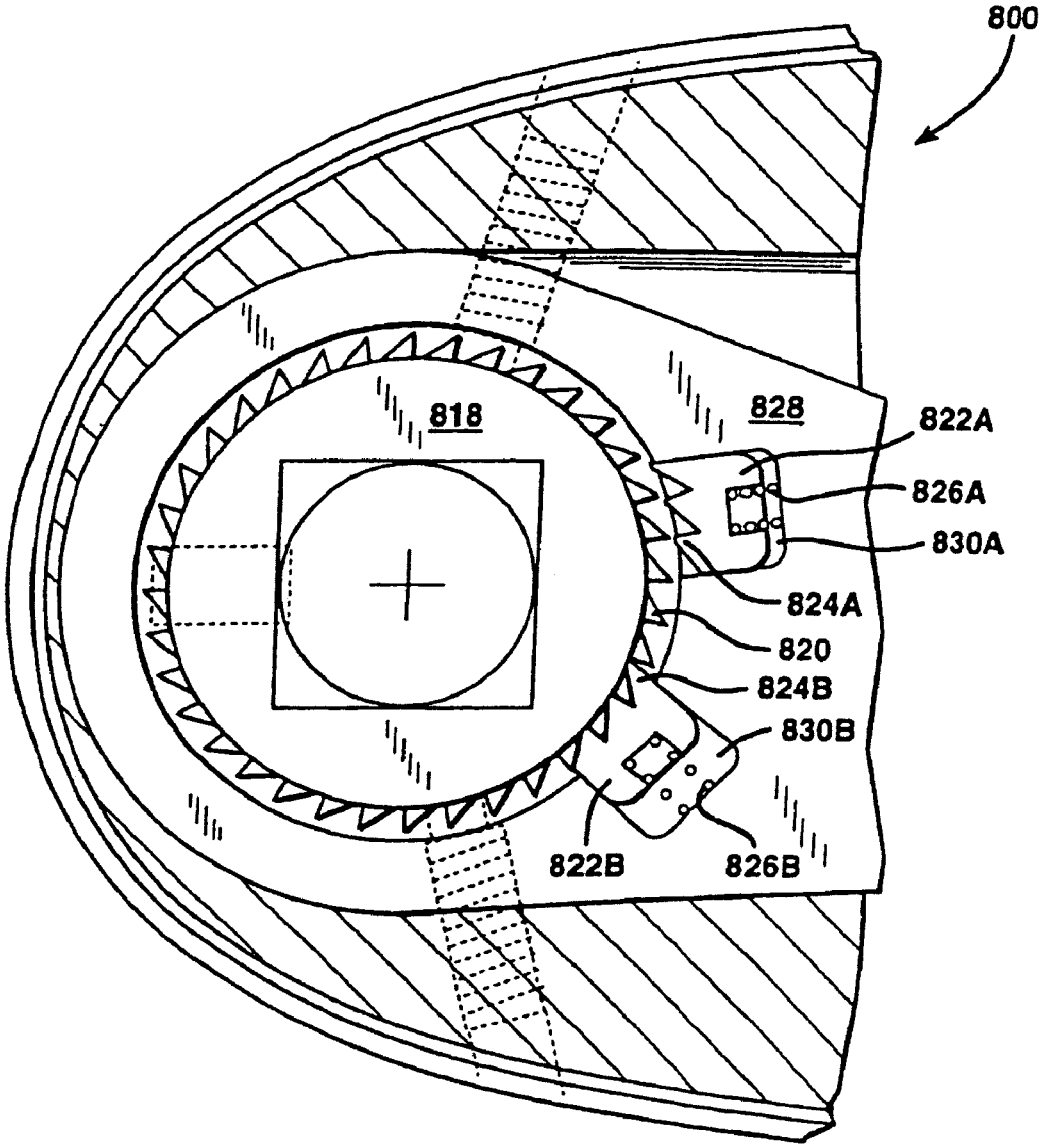
FIG. 18 is a partial top view of a dual-pawl and ratchet assembly for a wrench with torque augmenting means known in the art.

FIG. 18 shows a dual-pawl assembly for another embodiment of the present invention. In this arrangement, pawls 822A,822B are of similar construction and have corresponding teeth 824A, 824B. The pawls are disposed in respective recesses 830A, 830B of the drive arm 828. The pawls 822A,B include springs 826A,B to be biased with respect to the ratchet teeth 820. It is preferred that when the teeth 824B of, for example, the pawl 822B have engaged the corresponding teeth 820 of the ratchet 828, the teeth 824A of the pawl 822A are no more than half way into engagement with corresponding teeth 820 of the ratchet 818. With this arrangement, as the torquing continues, and the pawls teeth 824B are extracted, the other pawls teeth 824A move into close engagement with the ratchet teeth 820 to prevent any loss of torque already obtained. In all other aspects, the elements and operations thereof are the same as those shown with respect to FIGS. 14–16.

Figure 19:
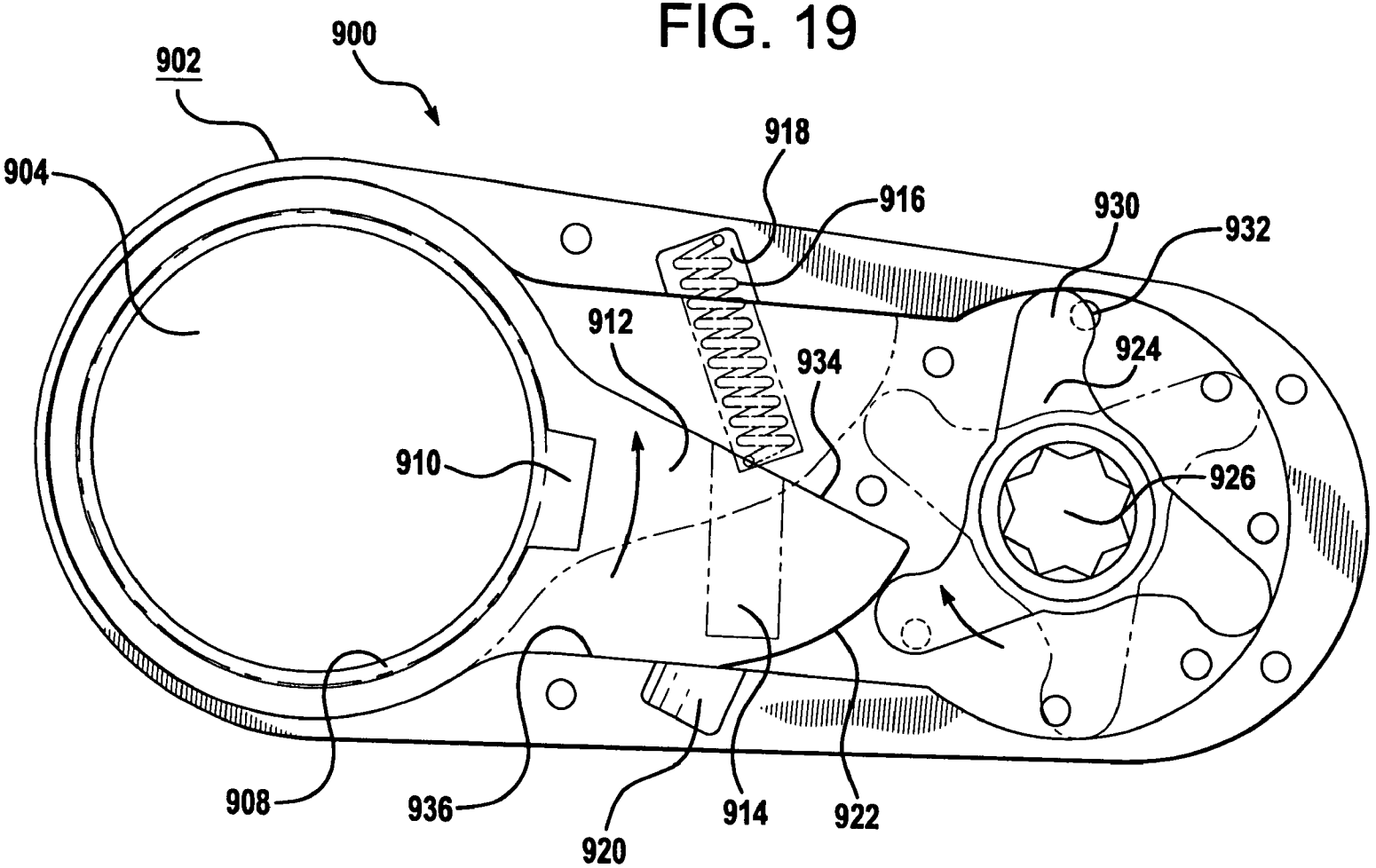
FIG. 19 is a schematic view of the components forming the Constant Rotation Rotary Torque Multiplier of the present invention.
Figure 20:
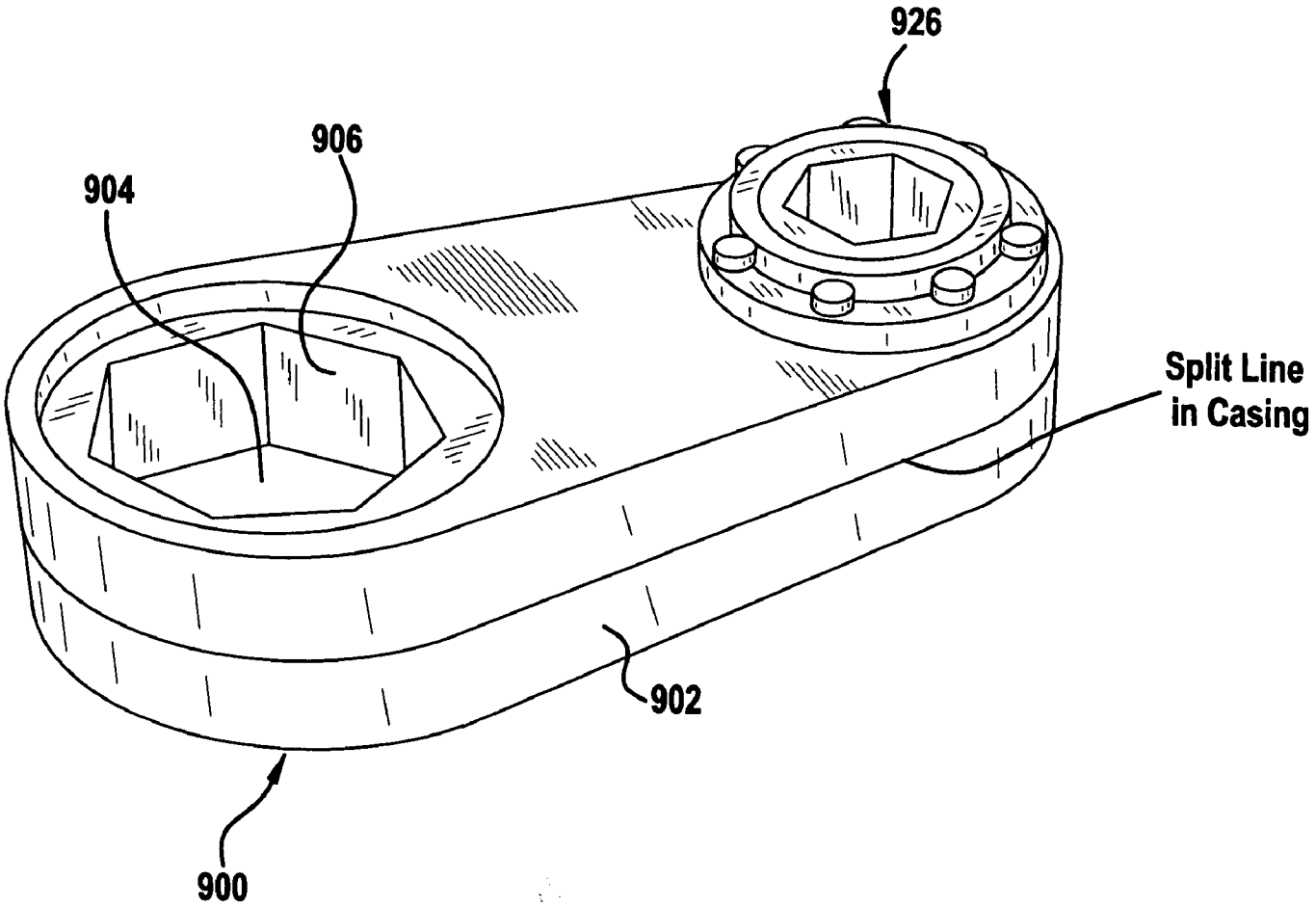
FIG. 20 shown an external view of the present invention.
Figure 21:
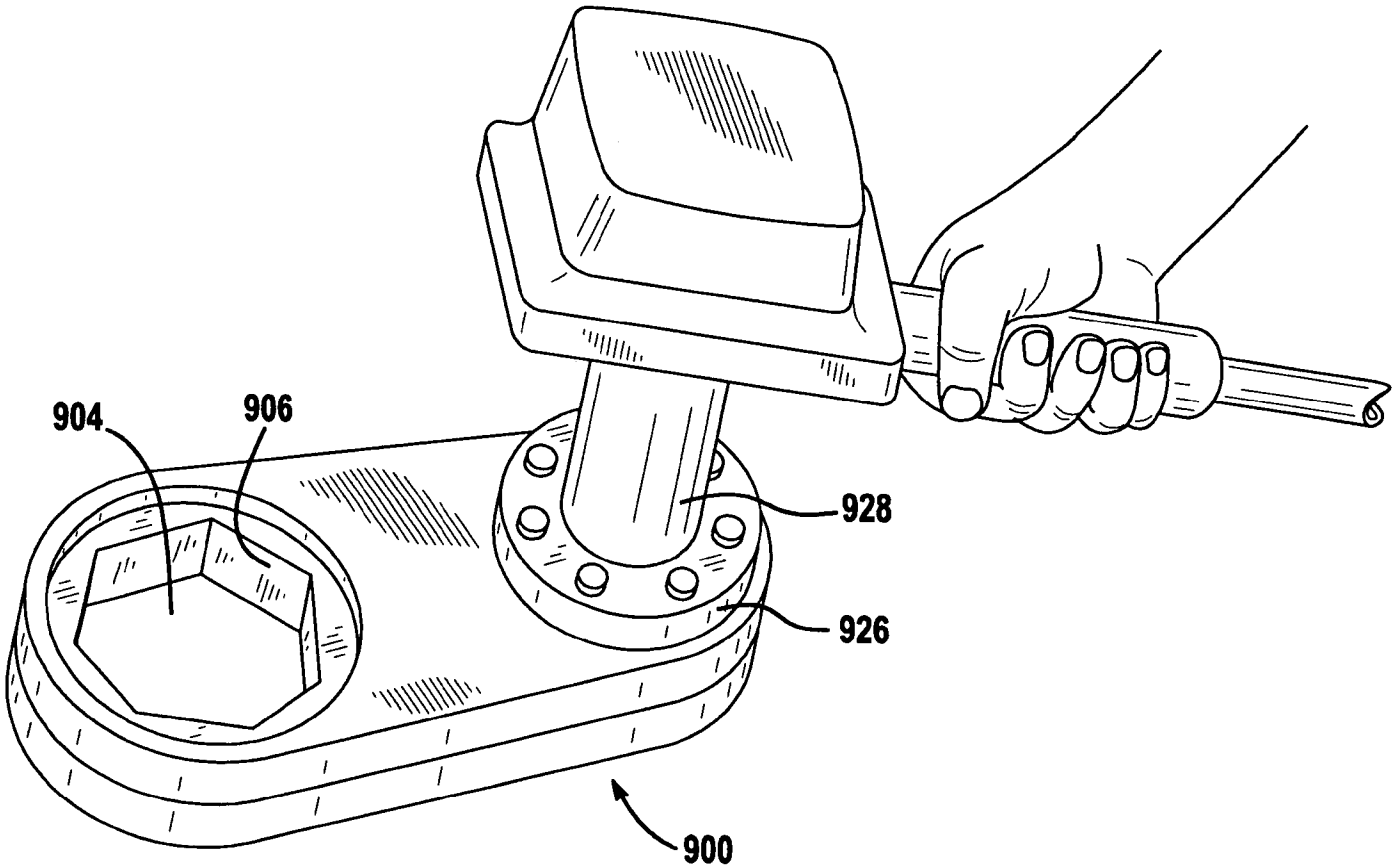
FIG. 21 shows a view of the present invention connected with an external power tool.

FIGS. 19, 20 and 21 show the embodiment of the present invention, a wrench with torque augmenting means in which the input to the wrench can be continuously rotates to produce an oscillated augmented power stroke from the output of the wrench.

As shown in FIGS. 19,20, and 21 a constant torque multiplier 900 has a casing 902 in which is mounted an output 904 into which can be placed a socket 906 or a wrench (not shown) and which has a ratchet gear 908 which coacts with a ratchet paw 910 that is mounted in the drive plate 912 of the output. The drive plate of the output has a passage or spring receptacle 914 in it in which is mounted a spring 916 that is also connected to a recess 918 in the upper housing or casing 902. The spring urges the drive plate down to the lower end of the housing or casing 902. The end of the drive plate has a cam follower surface 922. At the other end of the housing is rotatably mounted an input cog 924 which has an input socket for insertion of a drive member from a rotary power tool 928 or from any other torque providing tool.

The input clog 924 is in effect a cog having several arms 930. As shown in this embodiment, there are three arms. Each of the arms 930 has a camming surface 932 which is constructed to engage the cam follower surface 922 of the drive plate 912. As the cog arm rotates, the camming surface will eventually engage the cam follower surface of the drive plate. As shown in FIG. 19, the input cog rotates in a clockwise direction which will cause the drive plate to rotate in the counter-clockwise direction. Initially the spring 916 which is connected to the flat side 934 of the drive plate 912 forces the drive plate downward against the lower inner wall of the casing. It will remain in this position under the urging of the spring until contacted by the camming surface 932 of the cog arm 930 that is rotating and engages the cam follower surface 922 of the drive plate 912. The torque from the input cog rotates the cog arm to overcome the urging of the spring and to rotate the drive plate counter-clockwise until the contact of the camming surface 932 of the cog arm 930 is lost due to rotation of the cog arm and then the drive plate will rotate under the urging of the spring back to its initial position. As the camming surface 932 of the cog arm 930 pushes past the end of the cam follower surface 922 on the drive arm, it will produce a clearance and will continue to rotate coming out of contact with the drive arm.

It is noted that there is a lower spring recess 920 in the lower wall of the casing so that the drive plate and input cog can be turned upside down and the spring then repositioned from the upper to the lower end of the casing to engage the recess in the drive plate and thereby reverse the operative direction of the unit from counter-clockwise direction of the output to a clockwise direction of the output.

The travel of the drive plate 912 is limited by the contact of the flat side 934 of the drive plate with the adjacent wall of housing 902 at one end and the contact of the curved side 936 of the drive plate 912 with the wall of housing 902 at the other end.

There are different variations possible with respect to the number of cog arms. The input cog can have one, two, three or four cog arms.

The mechanical advantage is expressed by the difference in the angular rotation between the cog arms and the drive plate. So, for a 3;1 torque augmentation ratio, the drive plate will rotate 40° while the input cog will rotate approximately 120°.

Accordingly, it can be seen that the present invention is extremely useful and versatile.

It will be understood that the embodiments described herein are merely exemplary and that a person skilled in the art may make many variations and modifications without departing from the spirit and scope of the invention. All such modifications and variations are intended to be included within the scope of the invention as described herein.

I claim:

1. A wrench with torque augmenting means comprising:
a housing;
a continuously rotatable power input in the housing for connecting a rotary source of power to the housing;
a torque output in the housing;
the torque output operatively connected to the power input to move from an initial position to a final position; and
means in the housing operatively connected to the torque output to move the torque output back to the initial position as power input continuously rotates.

2. A wrench with torque augmenting means according to claim 1, further comprising:
camming means on said continuously rotatably power input and said torque output.

3. A wrench with torque augmenting means according to claim 2, wherein:
the continuously rotatable power input in the housing for connecting a rotary source of power to the housing further comprising;
a rotary cog, and
a camming surface on the rotary cog;
the torque output in the housing further comprising;
a camming surface on the torque output coating with the camming surface on the rotary cog.

4. A wrench with torque augmenting means according to claim 3, wherein:
the rotary cog further comprises;
an arm extending from the cog, and
a camming surface on the end of the arm.

5. A wrench with torque augmenting means according to claim 3, wherein:
the torque output in the housing further comprising;
a drive plate,
a cam follower surface formed on the drive plate coacting with the camming surface on the rotary cog.

6. A wrench with torque augmenting means according to claim 5, wherein:
the rotary cog further comprises;
an arm extending from the cog,
a camming surface on the end of the arm,
the camming surface on the end of the arm coacting with the cam follower surface on the drive plate.

7. A wrench with torque augmenting means according to claim 1, further comprising:
the means in the housing operatively connected to the torque output to move the torque output back to the initial position as power input continuously rotates, comprising;
a ratchet and pawl operatively positioned in the torque output to enable ratcheted movement of the output.

8. A wrench with torque augmenting means, according to claim 1, further comprising:
the means in the housing operatively connected to the torque output to move the torque output to move the torque output back to the initial position as power input continuously rotates, comprising;
a resilient means coacting with the wall of the housing and the output to urge the output to the initial position.

9. A wrench with torque augmenting means, according to claim 1, further comprising:
the means in the housing operatively connected to the torque output to move the torque output back to the initial position as power input continuously rotates, comprising;
a ratchet and pawl operatively positioned in the torque output to enable ratcheted movement of the output,
the means in the housing operatively connected to the torque output to move the torque output back to the initial position as power input continuously rotates, comprising;
resilient means coacting with the wall of the housing and the output to urge the output to the initial position.

10. A wrench with torque augmenting means according to claim 1, further comprising:
camming means on said continuously rotatable power input and said torque output, the continuously rotatable power input in the housing for connecting a rotary source of power to the housing, further comprising;
a rotary cog,
a camming surface on the rotary cog,
the torque output in the housing, further comprising:
a camming surface on the torque output coacting with the camming surface on the rotary cog,
the rotary cog, further comprises an arm extending from the cog,
a camming surface on the end of the arm,
the torque output in the housing, further comprising:
a drive plate
a cam follower surface formed on the drive plate coacting with the camming surface on the rotary cog,
the rotary cog, further comprises an arm extending from the cog;

a camming surface on the end of the arm, the camming surface on the end of the arm coacting with the cam follower surface on the drive plate, the means in the housing operatively connected to the torque output to move the torque output back to the initial position as power input continuously rotates, comprising:

a ratchet and pawl operatively positioned in the torque output to enable ratcheted movement of the output;

the means in the housing operatively connected to the torque output to move the torque output back to the initial position as power input continuously rotates, comprising:

resilient means coacting with the wall of the housing and the output to urge the output to the initial position.

* * * * *